US011056050B2

(12) United States Patent
Yano et al.

(10) Patent No.: US 11,056,050 B2
(45) Date of Patent: Jul. 6, 2021

(54) DISPLAY UNIT, IMAGE PROCESSING UNIT, AND DISPLAY METHOD FOR IMPROVING IMAGE QUALITY

(71) Applicant: Sony Corporation, Tokyo (JP)

(72) Inventors: Tomoya Yano, Kanagawa (JP); Makoto Nakagawa, Tokyo (JP); Mitsuyasu Asano, Tokyo (JP); Yasuo Inoue, Tokyo (JP); Shoji Araki, Kanagawa (JP); Hidehisa Shimizu, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/503,045

(22) Filed: Jul. 3, 2019

(65) Prior Publication Data

US 2019/0325817 A1 Oct. 24, 2019

Related U.S. Application Data

(63) Continuation of application No. 15/914,354, filed on Mar. 7, 2018, now Pat. No. 10,373,551, which is a (Continued)

(30) Foreign Application Priority Data

Jun. 14, 2012 (JP) ..... 2012-134373

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2300/0452* (2013.01); (Continued)

(58) Field of Classification Search
CPC ..... G09G 3/3208; G09G 3/2003; G09G 2300/0452; G09G 2320/0646; (Continued)

(56) References Cited

U.S. PATENT DOCUMENTS 5,452,018 A * 9/1995 Capitant ..... H04N 9/68 348/649
7,782,335 B2 * 8/2010 Baek ..... G09G 3/3607 345/586

(Continued)

FOREIGN PATENT DOCUMENTS

JP 2004326082 A 11/2004
JP 2010-038954 A 2/2010

(Continued)

OTHER PUBLICATIONS

Korean Office Action dated May 7, 2019 for corresponding Korean Office Application No. 10-2013-0064439.

(Continued)

*Primary Examiner* — Julie Anne Watko
(74) *Attorney, Agent, or Firm* — Michael Best & Friedrich LLP

(57) ABSTRACT

An image processing unit includes: a gain calculating section obtaining, based on first luminance information for each pixel, a first gain, in which the first gain is configured to increase with an increase in pixel luminance value in a range where the pixel luminance value is equal to or larger than a predetermined luminance value, and in which the pixel luminance value is derived from the first luminance information; and a determination section determining, based on the first luminance information and the first gain, second luminance information for each of the pixels.

20 Claims, 23 Drawing Sheets

Related U.S. Application Data continuation of application No. 13/899,030, filed on May 21, 2013, now Pat. No. 9,940,870.

(52) U.S. Cl.
CPC ..... *G09G 2320/066* (2013.01); *G09G 2320/0646* (2013.01); *G09G 2320/0666* (2013.01); *G09G 2340/06* (2013.01); *G09G 2360/147* (2013.01); *G09G 2360/16* (2013.01)

(58) Field of Classification Search
CPC ..... G09G 2320/066; G09G 2320/0666; G09G 2340/06; G09G 2360/47; G09G 2360/16; G09G 2340/16; G09G 2360/147; G09G 2320/0242; G09G 3/3413; G09G 3/3607; G09G 3/3406; G09G 2320/0285; G09G 2320/0233; G09G 2320/0673; G09G 2320/0276; G09G 2320/0271; G09G 2320/041; G09G 2320/0626; G09G 2330/025; G09G 5/04; G09G 5/02; G09G 5/06; G09G 5/10; G06T 5/002; G06T 5/009; G06T 5/008; G06T 5/50; G06T 5/007; G06T 7/90; G06T 2207/10024; G06T 2207/20208; G06T 2207/20012
USPC ..... 345/690
See application file for complete search history.

(56) References Cited

U.S. PATENT DOCUMENTS

2003/0020736 A1* 1/2003 Kimura ..... H04N 9/73 345/690
2004/0036703 A1* 2/2004 Aoki ..... G09G 5/10 345/690
2004/0212739 A1* 10/2004 Kiuchi ..... H04N 5/20 348/674
2006/0187232 A1 8/2006 Kempf et al.
2006/0284805 A1* 12/2006 Baek ..... G09G 3/3607 345/88
2007/0115392 A1* 5/2007 Masuda ..... H04N 21/44008 348/678
2008/0150970 A1 6/2008 Atsushi et al.
2009/0315921 A1 12/2009 Sakaigawa et al.
2010/0026705 A1 2/2010 Im et al.
2010/0026731 A1* 2/2010 Konuma ..... G09G 5/04 345/690
2010/0259685 A1* 10/2010 Isobe ..... H04N 5/208 348/645
2011/0267379 A1 11/2011 Kurabayashi et al.
2012/0026211 A1* 2/2012 Kikuchi ..... G09G 3/3607 345/690
2012/0306947 A1* 12/2012 Kim ..... G09G 3/2003 345/694
2013/0342587 A1* 12/2013 Nakagawa ..... G09G 3/3208 345/690
2014/0176620 A1* 6/2014 Yano ..... G09G 3/3208 345/690

FOREIGN PATENT DOCUMENTS

JP 2010-039199 A 2/2010
KR 20060133194 A 12/2006
WO WO-2010137387 A1 * 12/2010 ..... H04N 5/142

OTHER PUBLICATIONS

Korean Office Action dated Nov. 29, 2019 for corresponding Korean Application No. 10-2013-0064439.

* cited by examiner

FIG. 4A
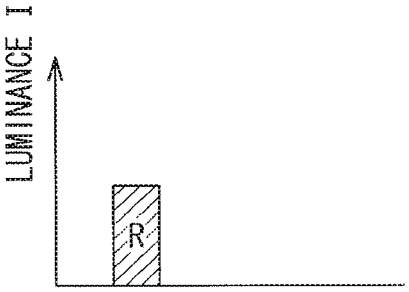
FIG. 4B
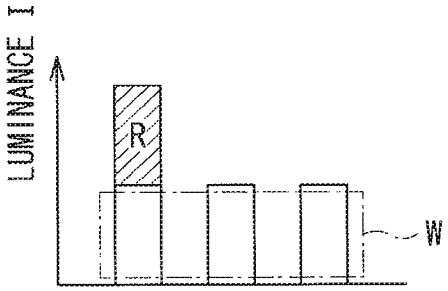
FIG. 4C
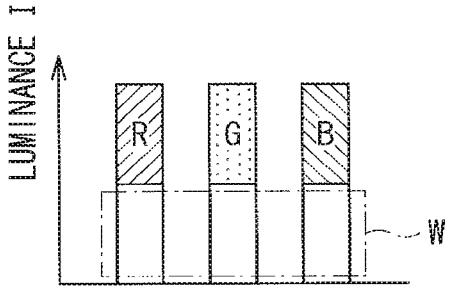
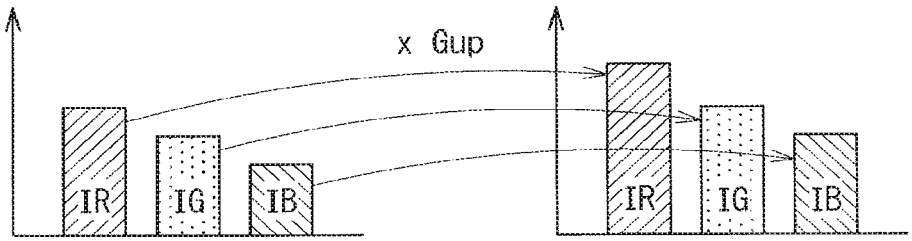
FIG. 5

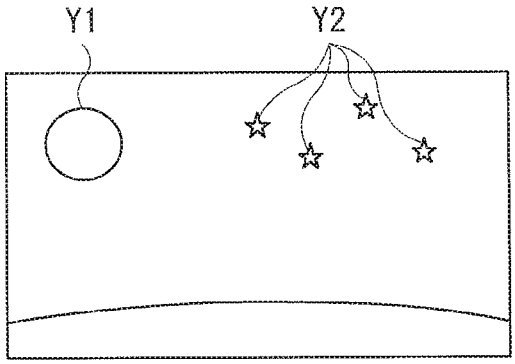
FIG. 15
FIG. 16A
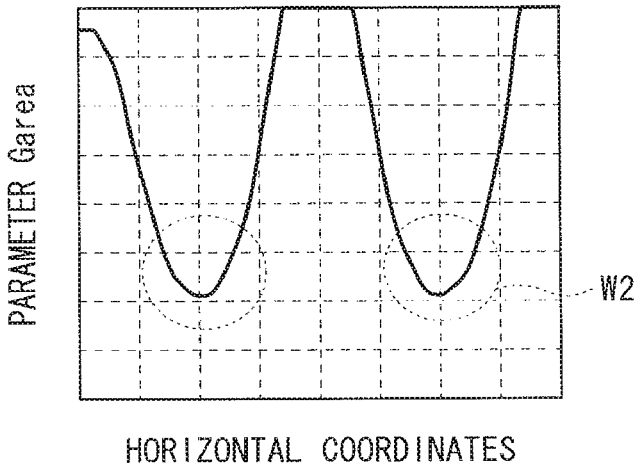
FIG. 16B
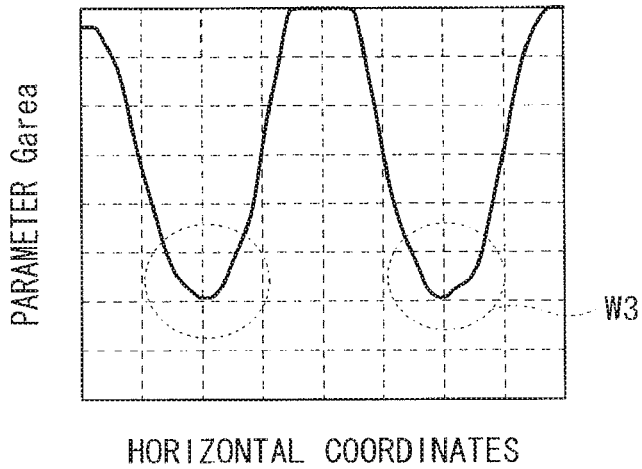

DISPLAY UNIT, IMAGE PROCESSING UNIT, AND DISPLAY METHOD FOR IMPROVING IMAGE QUALITY

CROSS REFERENCE TO RELATED APPLICATIONS

The present application is a Continuation of application Ser. No. 15/914,354, filed Mar. 7, 2018, which is a Continuation of application Ser. No. 13/899,030, filed May 21, 2013, now U.S. Pat. No. 9,940,870 issued on Apr. 10, 2018, which claims the benefit of Japanese Priority Patent Application JP 2012-134373 filed Jun. 14, 2012, the entire contents of which are incorporated herein by reference.

BACKGROUND

The present disclosure relates to a display unit displaying an image, and an image processing unit for use in such a display unit, and a display method.

Recently, a cathode ray tube (CRT) display unit has been actively replaced with a liquid crystal display unit or an organic electro-luminescence (EL) display unit. The liquid crystal display unit and the organic electro-luminescence display unit are each being a mainstream display unit due to low power consumption and a flat configuration thereof.

Display units are in general desired to have high image quality. Image quality is determined by various factors including contrast. Increase of peak luminance may be a technique for improving contrast. Specifically, reduction of a black level is limited by reflection of outside light, etc. Hence, in the above technique, peak luminance is increased (extended) to improve contrast. For example, Japanese Unexamined Patent Application Publication No. 2008-158401 (JP-A-2008-158401) discloses a display unit, in which an increasing level (extending level) of peak luminance and gamma characteristics are each varied depending on an average of image signals to achieve improvement in image quality and reduction in power consumption.

In some display units, each pixel is configured of four sub-pixels. For example, Japanese Unexamined Patent Application Publication No. 2010-33009 discloses a display unit, in which each pixel is configured of sub-pixels of red, green, blue, and white to improve luminance or reduce power consumption, for example.

SUMMARY

As described above, display units are desired to achieve high image quality. Hence, further improvement in image quality is expected for the display units.

It is desirable to provide a display unit, an image processing unit, and a display method capable of improving image quality.

A display unit according to an embodiment of the disclosure includes: a gain calculating section obtaining, based on first luminance information for each pixel, a first gain, in which the first gain is configured to increase with an increase in pixel luminance value in a range where the pixel luminance value is equal to or larger than a predetermined luminance value, and in which the pixel luminance value is derived from the first luminance information; a determination section determining, based on the first luminance information and the first gain, second luminance information for each of the pixels; and a display section performing display based on the second luminance information.

An image processing unit according to an embodiment of the disclosure includes: a gain calculating section obtaining, based on first luminance information for each pixel, a first gain, in which the first gain is configured to increase with an increase in pixel luminance value in a range where the pixel luminance value is equal to or larger than a predetermined luminance value, and in which the pixel luminance value is derived from the first luminance information; and a determination section determining, based on the first luminance information and the first gain, second luminance information for each of the pixels.

A display method according to an embodiment of the disclosure includes: obtaining, based on first luminance information for each pixel, a first gain, in which the first gain increases with an increase in pixel luminance value in a range where the pixel luminance value is equal to or larger than a predetermined luminance value, and in which the pixel luminance value is derived from the first luminance information; determining, based on the first luminance information and the first gain, second luminance information for each of the pixels; and performing display based on the second luminance information.

In the display unit, the image processing unit, and the display method according to the above-described respective embodiments, the first gain is obtained based on the first luminance information, the second luminance information is determined based on the first luminance information and the first gain, and the display is performed based on the second luminance information. In the range where the pixel luminance value derived from the first luminance information is equal to or larger than the predetermined luminance value, the first gain increases with the increase in the pixel luminance value.

According to the display unit, the image processing unit, and the display method of the above-described respective embodiments, the first gain is configured to increase with the increase in the pixel luminance value in the range where the pixel luminance value derived from the first luminance information is equal to or larger than the predetermined luminance value. Therefore, it is possible to improve image quality.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIGS. 4A to 4C are explanatory diagrams illustrating exemplary luminance information.

FIG. 5 is an explanatory diagram illustrating an exemplary operation of a peak luminance extending section illustrated in FIG. 1.

FIG. 15 is an explanatory diagram illustrating another exemplary operation of the peak luminance extending section illustrated in FIG. 1.

FIGS. 16A and 16B are explanatory diagrams illustrating an exemplary operation of the Garea calculating section illustrated in FIG. 7.

DETAILED DESCRIPTION

Hereinafter, some embodiments of the present disclosure are described in detail with reference to the accompanying drawings. It is to be noted that description is made in the following order.

1. First Embodiment
2. Second Embodiment
3. Third Embodiment
4. Fourth Embodiment
5. Application Examples

1. First Embodiment

[Exemplary Configuration]

(Exemplary Overall Configuration)

Figure 1:
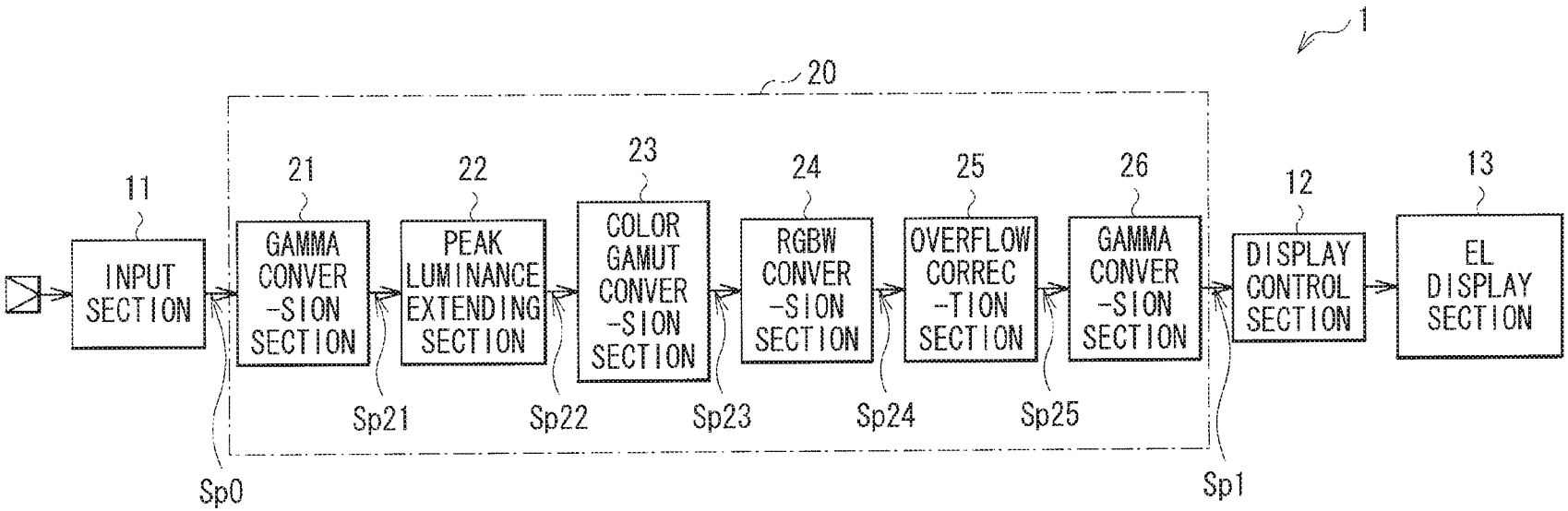
FIG. 1 is a block diagram illustrating an exemplary configuration of a display unit according to a first embodiment of the disclosure.

FIG. 1 illustrates an exemplary configuration of a display unit according to a first embodiment. The display unit 1 may be an EL display unit using an organic EL display element as a display element. It is to be noted that since an image processing unit and a display method according to respective example embodiments of the disclosure are embodied by this embodiment, they are described together. The display unit 1 includes an input section 11, an image processing section 20, a display control section 12, and an EL display section 13.

The input section 11 is an input interface, and generates an image signal Sp0 based on an image signal supplied from an external unit. In this exemplary case, the image signal supplied to the display unit 1 is a so-called RGB signal including red (R) luminance information IR, green (G) luminance information IG, and blue (B) luminance information IB.

As described later, the image processing section 20 performs predetermined image processing such as extending processing of peak luminance to the image signal Sp0 to generate an image signal Sp1.

The display control section 12 controls a display operation of the EL display section 13 based on the image signal Sp1. The EL display section 13 is a display section using an organic EL display element as a display element, and performs the display operation based on the control by the display control section 12.

Figure 2:
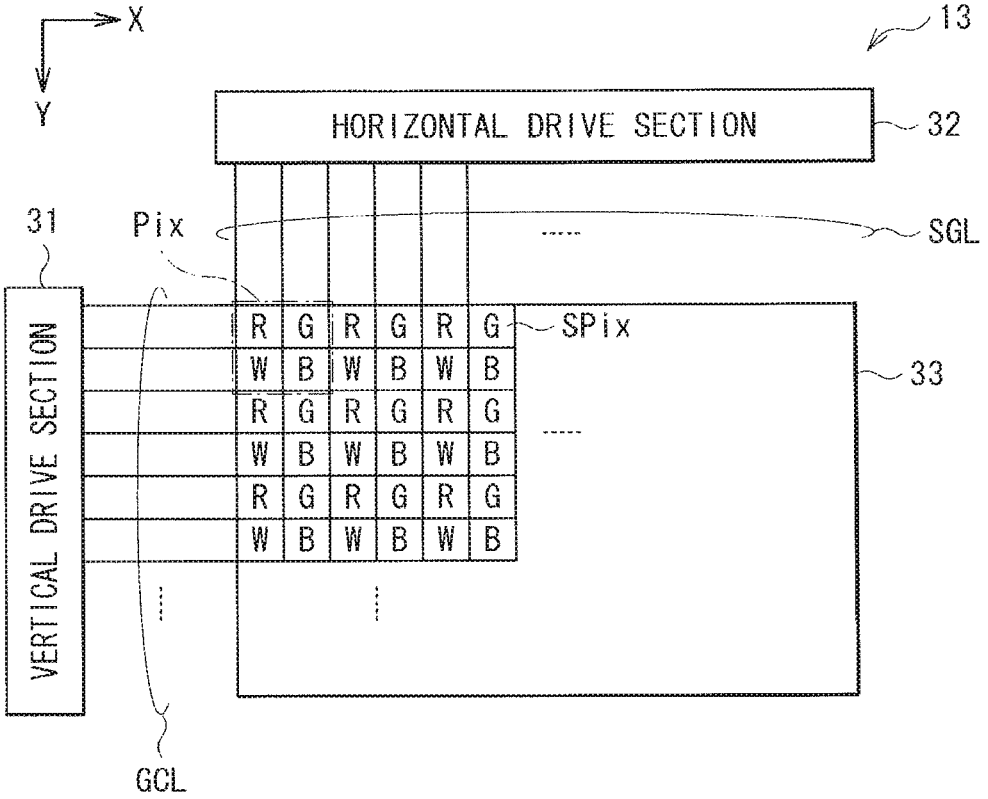
FIG. 2 is a block diagram illustrating an exemplary configuration of an EL display section illustrated in FIG. 1.

FIG. 2 illustrates an exemplary configuration of the EL display section 13. The EL display section 13 includes a pixel array section 33, a vertical drive section 31, and a horizontal drive section 32.

The pixel array section 33 includes pixels Pix arranged in a matrix. In this exemplary case, each pixel Pix is configured of four sub-pixels SPix of red (R), green (G), blue (B), and white (W). In this exemplary case, the pixel Pix includes such four sub-pixels Pix arranged in a 2×2 matrix. Specifically, the pixel Pix includes the sub-pixel SPix of red (R) arranged at upper left, the sub-pixel SPix of green (G) at upper right, the sub-pixel SPix of white (W) at lower left, and the sub-pixel SPix of blue (B) at lower right.

It is to be noted that colors of the four sub-pixels SPix are not limited thereto. For example, the white sub-pixel SPix may be replaced with a sub-pixel SPix of another color the luminosity factor for which is high as for white. More specifically, a sub-pixel SPix of a color (for example, yellow) may be preferably used, the luminosity factor for the color being equal to or higher than the luminosity factor for green that is highest among luminosity factors for red, green, and blue.

The vertical drive section 31 generates a scan signal based on timing control by the display control section 12, and supplies the scan signal to the pixel array section 33 through a gate line GCL to sequentially select the sub-pixel SPix in the pixel array section 33 at every line to perform line-sequential scan. The horizontal drive section 32 generates a pixel signal based on timing control by the display control section 12, and supplies the pixel signal to the pixel array section 33 through a data line SGL so that the pixel signal is supplied to each sub-pixel SPix in the pixel array section 33.

In this way, the display unit 1 displays an image with the four sub-pixels SPix. Consequently, a color gamut available for display is expanded as described below.

Figure 3A:
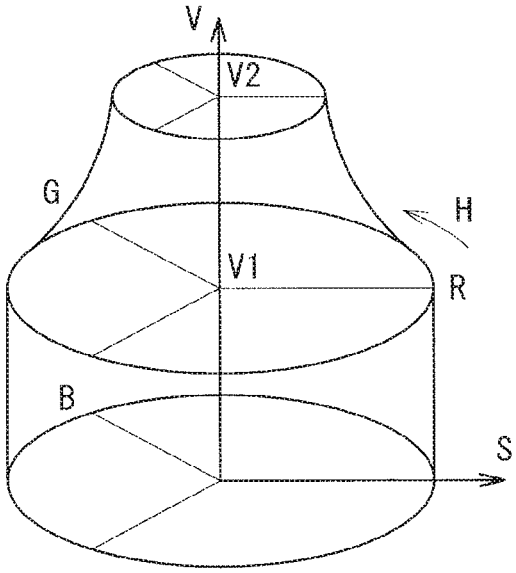
FIGS. 3A and 3B are schematic diagrams illustrating a HSV color space.
Figure 3B:
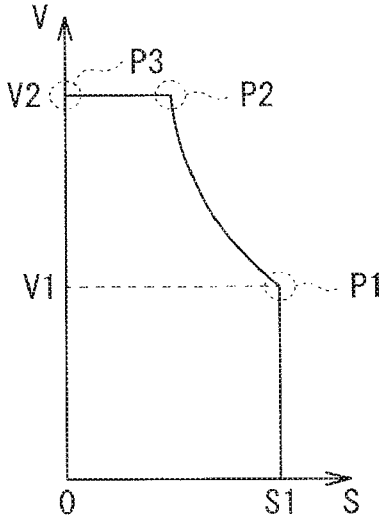

FIGS. 3A and 3B illustrate the color gamut of the display unit 1 in a HSV color space, where FIG. 3A is a perspective diagram, and FIG. 3B is a sectional diagram. In this exemplary case, the HSV color space is represented in a cylindrical shape. In FIG. 3A, a radial direction represents Saturation S, an azimuth direction represents Hue H, and an axial direction represents Value V. In this exemplary case, FIG. 3B illustrates a sectional diagram of a Hue H representing red. FIGS. 4A to 4C illustrate an exemplary light-emitting operation of the pixel Pix of the display unit 1.

For example, when only the red sub-pixel SPix emits light, colors in a range of Saturation S of S1 or less and Value V of V1 or less in FIG. 3B are representable. As illustrated in FIG. 4A, when only the red sub-pixel SPix emits light at maximum luminance, emission color corresponds to a point P1 (Saturation S="S1" and Value V="V1") in FIG. 3B in the HSV color space. The same holds true for each of green and blue. In other words, in FIG. 3A, a range of colors representable by the three sub-pixels SPix of red, green, and blue covers a lower half of the cylindrical shape (range of Value V of V1 or less).

On the other hand, as illustrated in FIG. 4B, when the red (R) and white (W) sub-pixels SPix each emit light with maximum luminance, emission color corresponds to a point P2 in FIG. 3B in the HSV color space. Furthermore, as illustrated in FIG. 4C, when the four sub-pixels SPix of red (R), green (G), blue (B), and white (W) each emit light at maximum luminance, emission color corresponds to a point P3 in FIG. 3B in the HSV color space. In other words, Value V is increased from V1 to V2 through light emission of the white sub-pixel SPix.

In this way, the white sub-pixel SPix is provided in addition to the sub-pixels SPix of red, green, blue, thereby the representable color gamut is expanded. Specifically, for example, when a luminance value of the case where all of the three sub-pixels Spix of red, green, and blue emit light at maximum luminance is equal to a luminance value of the case where the white sub-pixel Spix emits light at maximum luminance, the pixel Pix achieves luminance twice as high as luminance of the pixel including the three sub-pixels SPix of red, green, and blue.

(Image Processing Section 20)

The image processing section 20 includes a gamma conversion section 21, a peak luminance extending section 22, a color gamut conversion section 23, an RGBW conversion section 24, an overflow correction section 25, and a gamma conversion section 26.

The gamma conversion section 21 converts the received image signal Sp0 to an image signal Sp21 having linear gamma characteristics. Specifically, an image signal supplied from outside has a gamma value set to, for example, 2.2 in correspondence to characteristics of a common display unit, i.e., has nonlinear gamma characteristics. Hence, the gamma conversion section 21 converts such nonlinear gamma characteristics to linear gamma characteristics to facilitate processing in the image processing section 20. The gamma conversion section 21 may include, for example, a lookup table (LUT) that is used to perform such gamma conversion.

The peak luminance extending section 22 extends peak luminance of each of pieces of luminance information IR, IG, and IB contained in the image signal Sp21 to generate an image signal Sp22.

FIG. 5 schematically illustrates an exemplary operation of the peak luminance extending section 22. The peak luminance extending section 22 obtains a gain Gup based on the three pieces of luminance information IR, IG, and IB information P) corresponding to each pixel Pix, and multiplies the respective pieces of luminance information IR, IG, and IB by the gain Gup. In this operation, as described later, the gain Gup increases as a color represented by the three pieces of luminance information IR, IG, and IB is closer to white. Consequently, the peak luminance extending section 22 serves to more extend the respective pieces of luminance information IR, IG, and IB as the color is closer to white.

Figure 6:
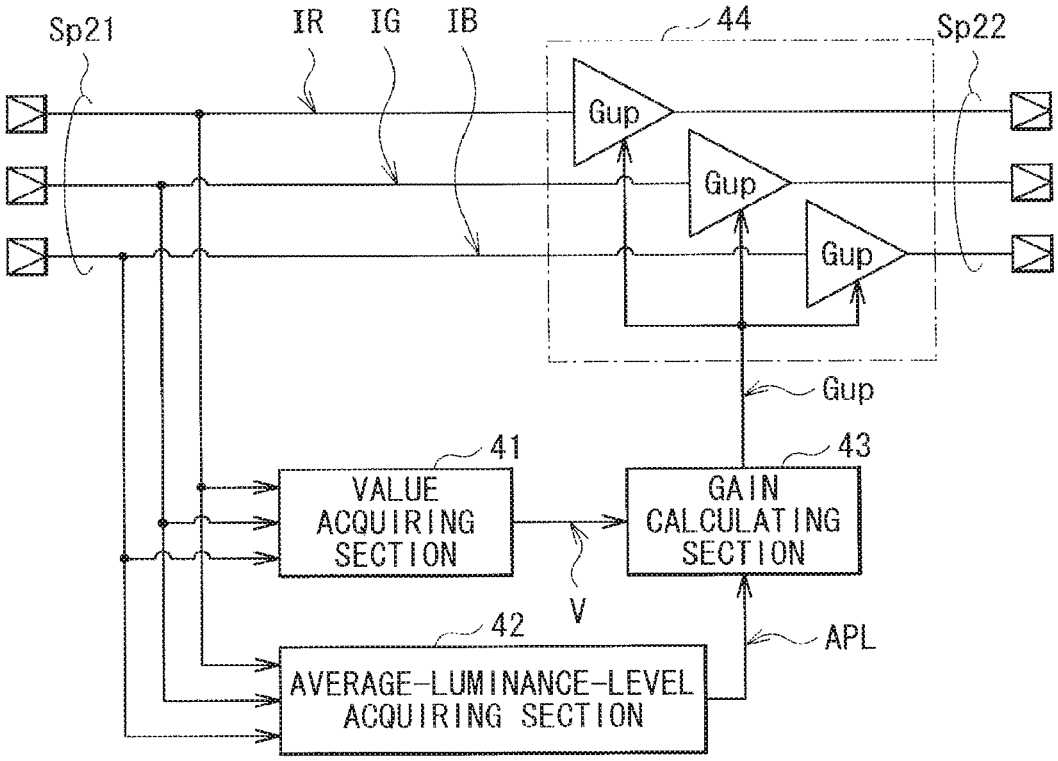
FIG. 6 is a block diagram illustrating an exemplary configuration of the peak luminance extending section illustrated in FIG. 1.

FIG. 6 illustrates an exemplary configuration of the peak luminance extending section 22. The peak luminance extending section 22 includes a Value acquiring section 41, an average-luminance-level acquiring section 42, a gain calculating section 43, and a multiplication section 44.

The Value acquiring section 41 acquires Values V in the HSV color space from the pieces of luminance information IR, IG, and IB contained in the image signal Sp21. Although Values V in the HSV color space are acquired in this exemplary case, the peak luminance extending section 22 is not limited thereto. Alternatively, for example, the peak luminance extending section 22 may be configured to acquire luminance L in the HSL color space, or may be configured to selectively acquire one of them.

The average-luminance-level acquiring section 42 obtains an average (average luminance level APL) of luminance information of a frame image, and outputs the average luminance level APL.

The gain calculating section 43 calculates the gain Gup based on the Value V for each of pieces of pixel information P supplied from the Value acquiring section 41 and the average luminance level APL of every frame image supplied from the average-luminance-level acquiring section 42.

Figure 7:
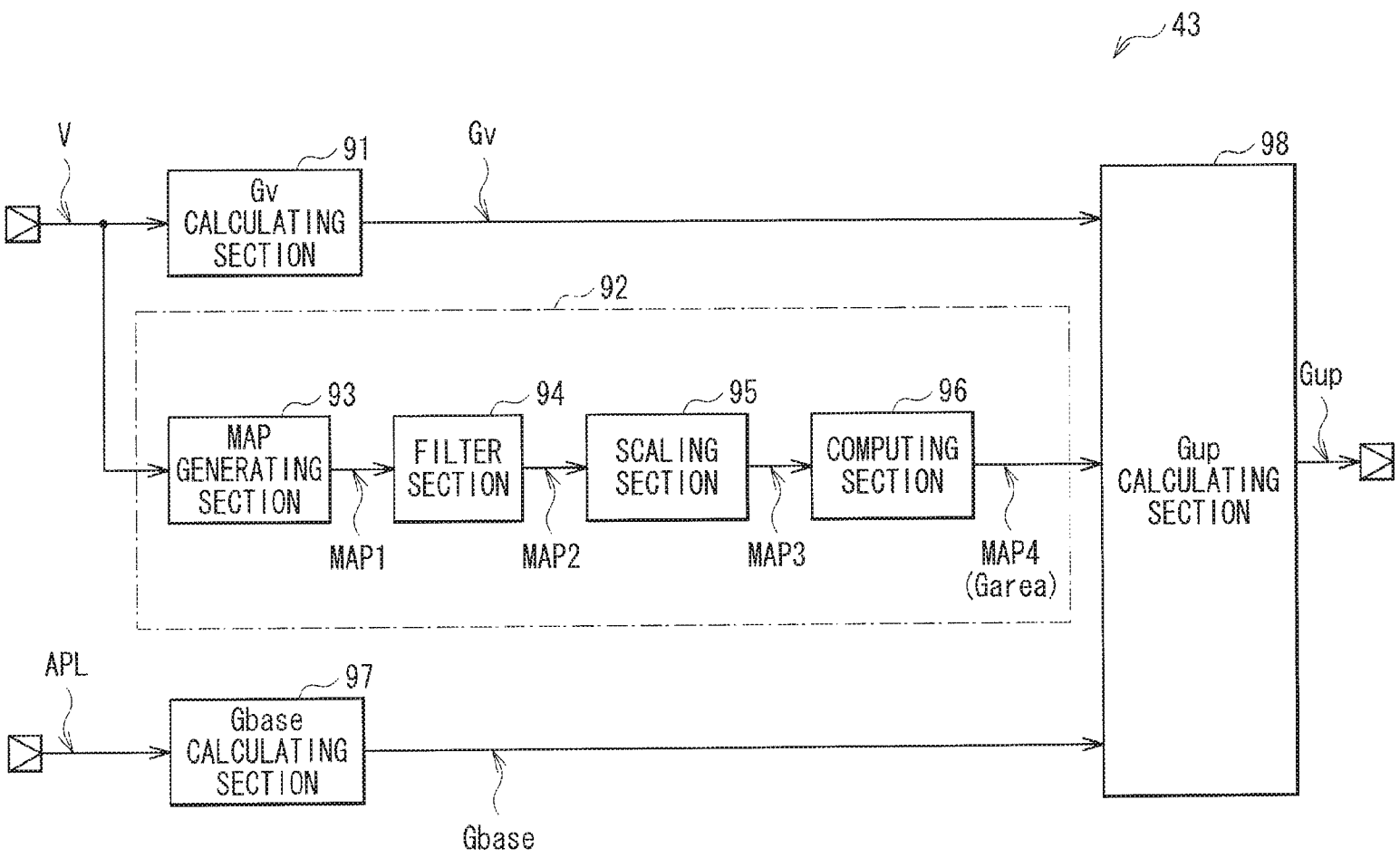
FIG. 7 is a block diagram illustrating an exemplary configuration of a gain calculating section illustrated in FIG. 6.

FIG. 7 illustrates an exemplary configuration of the gain calculating section 43. The gain calculating section 43 includes a Gv calculating section 91, a Garea calculating section 92, a Gbase calculating section 97, and a Gup calculating section 98.

The Gv calculating section 91 calculates a parameter Gv based on the Value V as described later. The parameter Gv is obtained through a function using the Value V.

The Garea calculating section 92 generates a map of a pararmeter Garea based on the Value V. The Garea calculating section 92 includes a map generating section 93, a filter section 94, a scaling section 95, and a computing section 96.

The map generating section 93 generates a map MAP1 based on the Value V obtained from each frame image. Specifically, the map generating section 93 divides an image region of a frame image into a plurality of (for example, 60×30) block regions B in horizontal and vertical directions, and calculates an average (region luminance information 1A) of the Values V for individual block regions B to generate the map MAP1. The region luminance information IA indicates an average of the Values V in a particular block region B, and is therefore has a larger value with a larger number of pieces of pixel information P having the high Value V, i.e., with an increase in area of a bright region in that block region B.

Although the map generating section 93 calculates the average of the Values V for individual block regions B in the exemplary case, the map generating section 93 is not limited thereto. Alternatively, for example, the map generating section may calculate the number of pieces of pixel information P having the Value V equal to or more than a predetermined value in each block region B.

The filter section 94 smoothens the region luminance information IA contained in the map MAP1 between the block regions B, to thereby generate a map MAP2. Specifically, the filter section 94 may be configured of, for example, a five-tap finite impulse response (FIR) filter.

The scaling section 95 performs enlarging scaling of the map MAP2 from a map in block units to a map in pixel information P units to generate a map MAP3. In other words, the map MAP3 has information of the Values V of which the number is the same as that of the pixels Pix of the EL display section 13. In that operation, the scaling section 95 may perform the enlarging scaling through interpolation processing such as, for example, linear interpolation or bucubic interpolation.

The computing section 96 generates a map MAP4 of the parameter Garea based on the map MAP3. The computing section 96 may include, for example, a lookup table, and uses the lookup table to calculate the parameter Garea for each of pieces of pixel information P based on individual data of the map MAP3.

The Gbase calculating section 97 calculates a parameter Gbase based on the average luminance level APL. The Gbase calculating section 97 may include, for example, a lookup table, and uses the lookup table to calculate the parameter Gbase based on the average luminance level APL, as described later.

As described later, the Gup calculating section 98 performs predetermined computing described later based on the parameters Gv, Gbase, and Garea to calculate the gain Gup.

In FIG. 6, the multiplication section 44 multiplies the respective pieces of luminance information IR, IG, and IB by the gain Gup calculated by the gain calculating section 43 to generate the image signal Sp22.

In FIG. 1, the color gamut conversion section 23 converts a color gamut and color temperature represented by the image signal Sp22 to a color gamut and color temperature, respectively, of the EL display section 13 to generate an image signal Sp23. Specifically, the color gamut conversion section 23 may perform color gamut conversion and color temperature conversion through, for example, 3×3 matrix conversion. For example, in an application where the conversion of the color gamut is not necessary such as the case where the color gamut of the input signal corresponds to the color gamut of the EL display section 13, only the conversion of the color temperature may be performed through processing using coefficient for correction of color temperature.

The RGBW conversion section 24 generates an RGBW signal based on the image signal Sp23 which is in a form of the RGB signal, and outputs the RGBW signal as an image signal Sp24. Specifically, the RGBW conversion section 24 converts the RGB signal containing the pieces of luminance information IR, IG, and IB of three colors of red (R), green (G), and blue (B) to the RGBW containing pieces of luminance information IR2, IG2, IB2, and IW2 of four colors of red (R), green (G), blue (B), and white (W).

Figure 8:
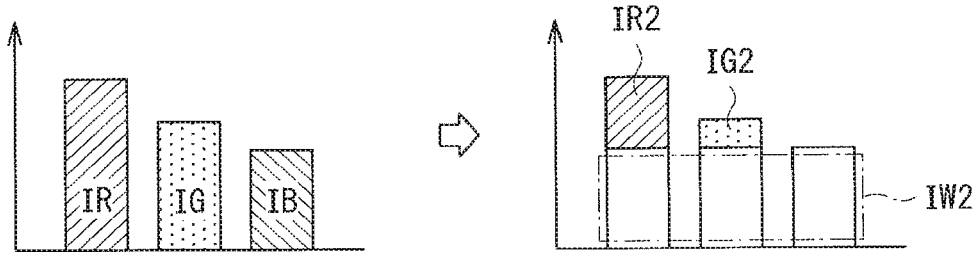
FIG. 8 is an explanatory diagram illustrating an exemplary operation of an RGBW conversion section illustrated in FIG. 1.

FIG. 8 schematically illustrates an exemplary operation of the RGBW conversion section 24. First, the RGBW conversion section 24 defines the smallest one (luminance information IB in this exemplary case) as luminance information IW2 among the three colors of the pieces of received luminance information IR, IG, and IB. Then, the RGBW conversion section 24 subtracts the luminance information IW2 from the luminance information ER to obtain the luminance information IR2, subtracts the luminance information IW2 from the luminance information IG to obtain the luminance information IG2, and subtracts the luminance information IW2 from the luminance information IB to obtain the luminance information IB2 (zero in this exemplary case). Then, the RGBW conversion section 24 outputs the thus-obtained pieces of luminance information IR2, IG2, IB2, and IW2 as the RGBW signal.

The overflow correction section 25 performs correction (overflow correction) such that each of the pieces of luminance information IR2, IG2, and IB2 contained in the image signal Sp24 does not exceed a predetermined luminance level, and outputs such a corrected image signal as an image signal Sp25.

Figure 9:
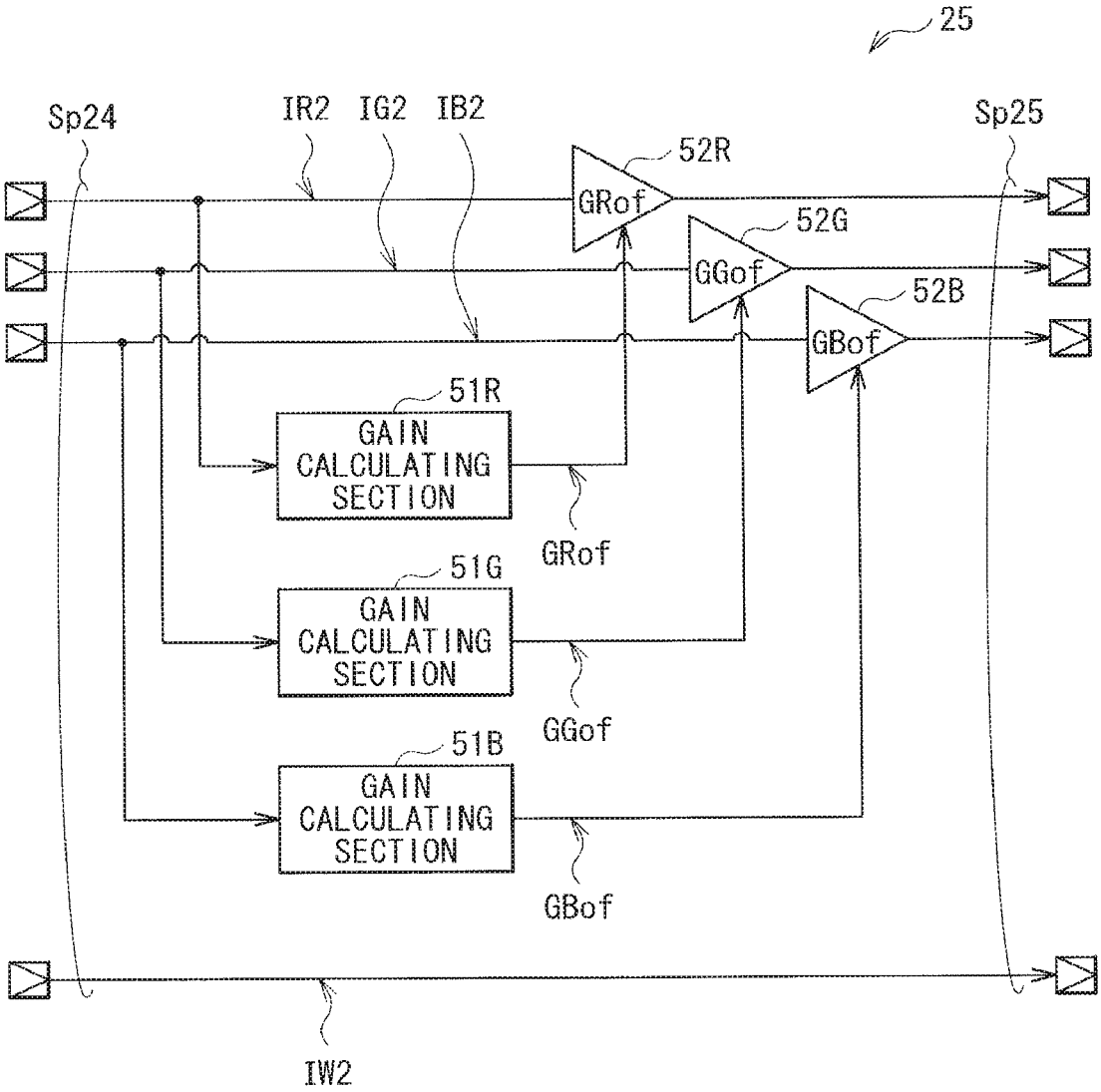
FIG. 9 is a block diagram illustrating an exemplary configuration of an overflow correction section illustrated in FIG. 1.

FIG. 9 illustrates an exemplary configuration of the overflow correction section 25. The overflow correction section 25 includes gain calculating sections 51R, 51G, and 51B, and amplifying sections 52R, 52G, and 52B. The gain calculating section 51R calculates a gain GR of based on the luminance information IR2. The amplifying section 52R multiplies that luminance information IR2 by that gain GRof. Similarly, the gain calculating section 51G calculates a gain GGof based on the luminance information IG2. The amplifying section 52G multiplies that luminance information IG2 by that gain GGof. The gain calculating section 51B calculates a gain GBof based on the luminance information IB2. The amplifying section 52B multiplies that luminance information IB2 by that gain GBof. The overflow correction section 25 performs no processing to the luminance information IW2 that is therefore output directly.

The gain calculating sections 51R, 51G, and 51B obtain the gains GRof, GGof, and GBof to prevent the pieces of luminance information IR2, IG2, and IB2 from exceeding predetermined luminance levels, respectively. The amplifying sections 52R, 52G, and 52B multiply the pieces of luminance information IR2, IG2, and IB2 by the gains GRof, GGof, and GBof, respectively.

The gamma conversion section 26 converts the image signal Sp25 having linear gamma characteristics to the image signal Sp1 having nonlinear gamma characteristics corresponding to the characteristics of the EL display section 13. The gamma conversion section 26 may include, for example, a lookup table as with the gamma conversion section 21, and uses the lookup table to perform such gamma conversion.

The multiplication section 44 corresponds to a specific example of "determination section" in one embodiment of the disclosure. The color gamut conversion section 23 and the RGBW conversion section 24 collectively corresponds to a specific example of "conversion section" in one embodiment of the disclosure. The overflow correction section 25 corresponds to a specific example of "correction section" in one embodiment of the disclosure. The gain Gup corresponds to a specific example of "first gain" in one embodiment of the disclosure. The Value V corresponds to a specific example of "pixel luminance value" in one embodiment of the disclosure. The image signal Sp21 corresponds to a specific example of "first luminance information" in one embodiment of the disclosure, the image signal Sp22 corresponds to a specific example of "second luminance information" in one embodiment of the disclosure, the image signal Sp24 corresponds to a specific example of "third luminance information" in one embodiment of the disclosure, and the image signal Sp25 corresponds to a specific example of "fourth luminance information" in one embodiment of the disclosure.

[Operations and Functions]

Operations and functions of the display unit 1 of this embodiment are now described.

(Summary of Overall Operation)

First, summary of an overall operation of the display unit 1 is described with reference to FIG. 1, etc. The input section 11 generates the image signal Sp0 based on an image signal supplied from an external unit. The gamma conversion section 21 converts the received image signal Sp0 to the image signal Sp21 having linear gamma characteristics. The peak luminance extending section 22 extends the peak luminance of the respective pieces of luminance information IR, IG, and IB contained in the image signal Sp21 to generate the image signal Sp22. The color gamut conversion section 23 converts the color gamut and the color temperature represented by the image signal Sp22 to the color gamut and the color temperature of the EL display section 13, respectively, to generate the image signal Sp23. The RGBW conversion section 24 generates the RGBW signal based on the image signal Sp23 which is in a form of the RGB signal, and outputs the RGBW signal as the image signal Sp24. The overflow correction section 25 performs correction such that each of the pieces of luminance information IR2, IG2, and IB2 contained in the image signal Sp24 does not exceed a predetermined luminance level, and outputs such a corrected image signal as the image signal Sp25. The gamma conversion section 26 converts the image signal Sp25 having the linear gamma characteristics to the image signal Sp1 having the nonlinear gamma characteristics corresponding to the characteristics of the EL display section 13. The display control section 12 controls a display operation of the EL display section 13 based on the image signal Sp1. The EL display section 13 performs the display operation based on the control by the display control section 12

(Peak Luminance Extending Section 22)

A detailed operation of the peak luminance extending section 22 is now described. In the peak luminance extending section 22, the Value acquiring section 41 acquires the Value V for each pixel Pix from the pieces of luminance information IR, IG, and IB contained in the image signal Sp21, and the average-luminance-level acquiring section 42 obtains the average of luminance information (the average luminance level APL) of a frame image. The gain calculating section 43 calculates the gain Gup based on the Value V and the average luminance level APL.

Figure 10:
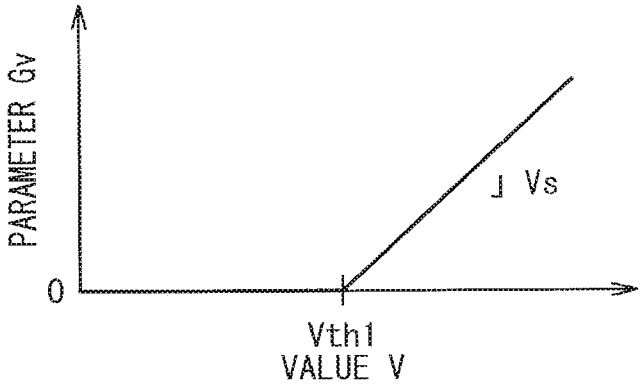
FIG. 10 is an explanatory diagram illustrating a parameter Gv relevant to a Gv calculating section illustrated in FIG. 7.

FIG. 10 illustrates an operation of the Gv calculating section 91 of the gain calculating section 43. As illustrated in FIG. 10, the Gv calculating section 91 calculates the parameter Gv based on the Value V. In this exemplary case, the parameter Gv is 0 (zero) for the Value V equal to or lower than a threshold Vth1, and increases linear-functionally at an inclination of Vs for the Value V equal to or higher than the threshold Vth1. In other words, the parameter Gv is specified by two parameters (the threshold Vth1 and the inclination Vs).

The Gbase calculating section 97 of the gain calculating section 43 calculates the parameter Gbase based on the average luminance level APL. The parameter Gbase decreases with an increase in average luminance level APL of the frame image (brightness while increases with a decrease in average luminance level APL of the frame image (brightness). The Gbase calculating section 97 obtains the parameter Gbase based on the average luminance level APL of every frame image supplied from the average-luminance-level acquiring section 42.

An operation of the Garea calculating section 92 is now described.

Figure 11A:
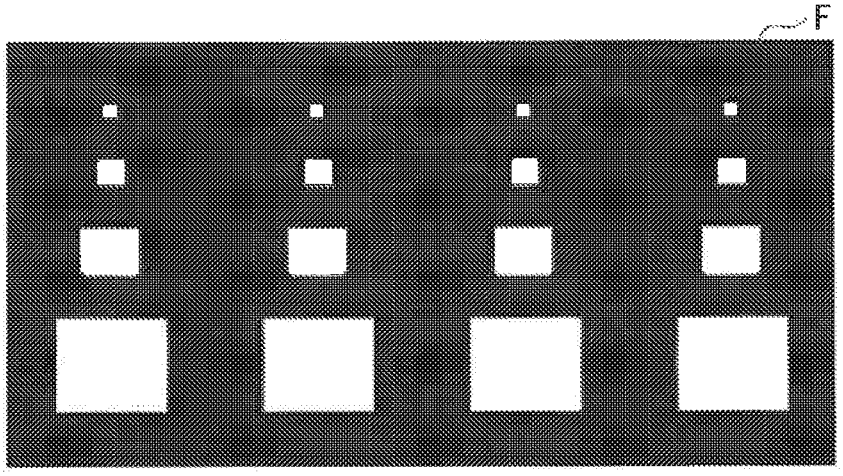
FIGS. 11A to 11C are explanatory diagrams illustrating an exemplary operation of a Garea calculating section illustrated in FIG. 7.
Figure 11B:
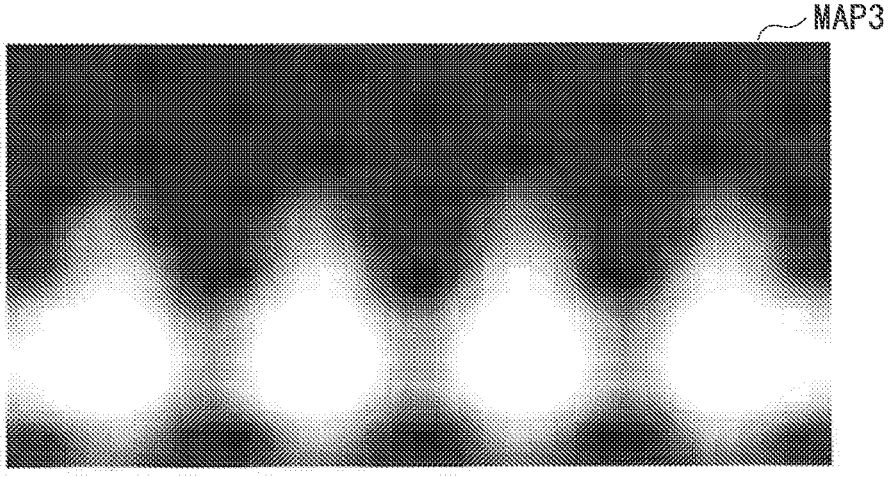
Figure 11C:
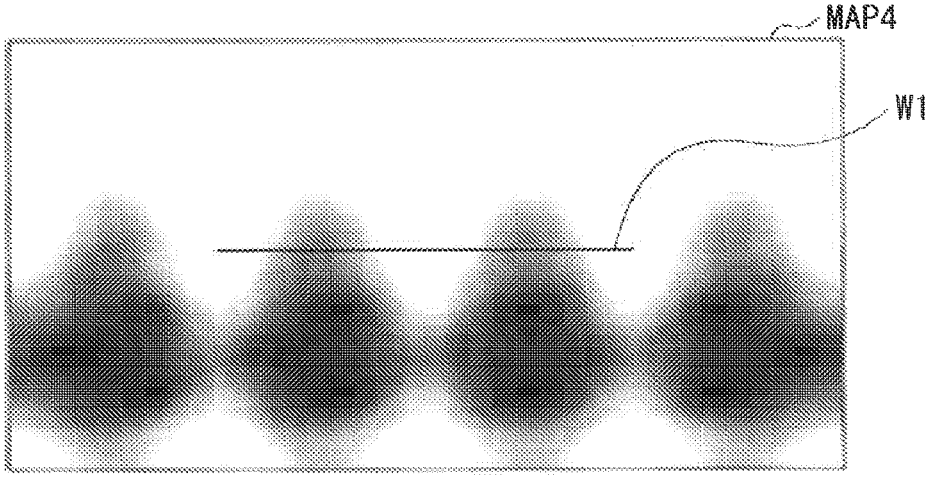

FIGS. 11A to 11C illustrate an exemplary operation of the Garea calculating section 92, where FIG. 11A illustrates a frame image F received by the display unit 1, FIG. 11B illustrates the map MAP3, and FIG. 11C illustrates the map MAP4 of the parameter Garea. In FIG. 11C, black shows that the parameter. Garea is small, and shows that the larger the parameter Garea is, the more whitish color it becomes.

In the display unit 1, first, the Value acquiring section 41 acquires the Value V for each of pieces of pixel information P based on the frame image F illustrated in FIG. 11A, and supplies the Value V to the Garea calculating section 92. In the Garea calculating section 92, first, the map generating section 93 calculates an average (region luminance information IA) of the Values V for individual block regions B to generate the map MAP1. The region luminance information IA has a larger value with an increase in number of pieces of pixel information P having the high Value V, i.e., with an increase in area of a bright region. Hence, the map MAP1 is a map indicating area of the bright region. The filter section 94 smoothens the region luminance information IA contained in the map MAP1 between the block regions B to generate the map MAP2.

Then, the scaling section 95 performs enlarging scaling of the map MAP2 into a map in pixel information P units through interpolation processing to generate the map MAP3 (FIG. 11B).

Then, the computing section 96 generates the map MAP4 (FIG. 11C) of the parameter Garea based on the map MAP3.

Figure 12:
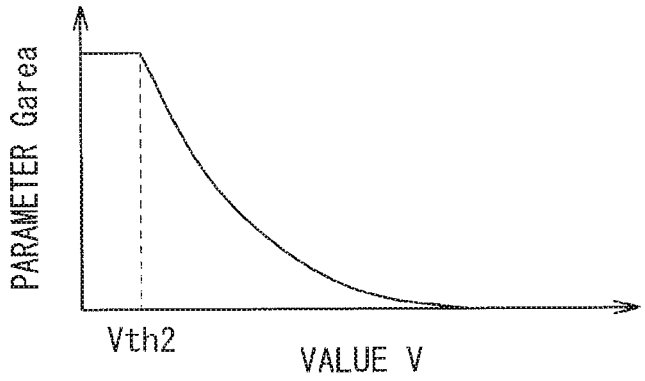
FIG. 12 is an explanatory diagram illustrating a parameter Garea relevant to the Garea calculating section illustrated in FIG. 7.

FIG. 12 illustrates an operation of the computing section 96. As illustrated in FIG. 12, the computing section 96 calculates the parameter Garea based on the individual Values V configuring the map MAP3. In this exemplary case, the parameter Garea has a fixed value for the Value V equal to or lower than a threshold Vth2, and decreases with an increase in Value V for the Value V equal to or higher than the threshold Vth2.

In this way, the computing section 96 calculates the parameter Garea based on the individual Values V configuring the map MAP3, to thereby generate the map MAP4 (FIG. 11C). In the map MAP4 (FIG. 11C), the parameter Garea decreases with an increase in area of a bright region (shown by black) of a frame image F (FIG. 11A), and increases with a decrease in area of the bright region (shown by white).

The Gup calculating section 98 calculates the gain Gup for each of pieces of pixel information P with the following Formula (1) based on the three parameters Gv, Gbase, Garea obtained in the above way.

$$Gup=(1+Gv\times Garca)\times Gbase \quad (1)$$

Figure 13:
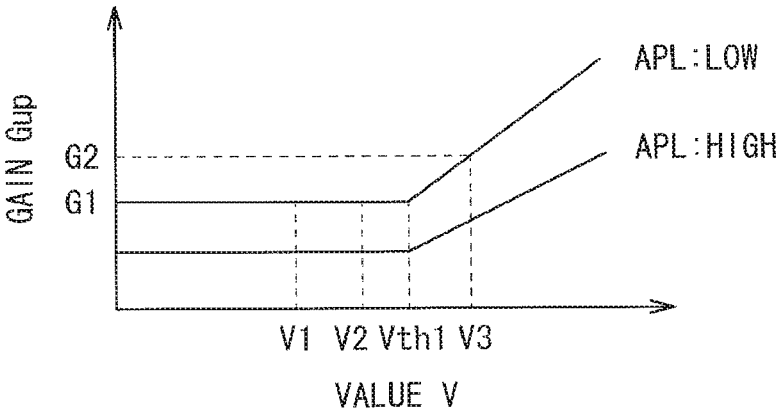
FIG. 13 is an explanatory diagram illustrating exemplary characteristics of the peak luminance extending section illustrated in FIG. 1.

FIG. 13 illustrates characteristics of the gain Gup. FIG. 13 illustrates two types of characteristics of the gain Gup, characteristics at the small average luminance level APL and characteristics at the large average luminance level APL under the condition that each average luminance level APL is constant (the parameter Gbase is constant). In this exemplary case, the parameter Garea is fixed for convenience of description. As illustrated in FIG. 13, the gain Gup has a fixed value for the Value V equal to or lower than the threshold Vth1, and increases with an increase in Value V for the Value V equal to or higher than the threshold Vth1. In other words, the gain Gup increases as a color represented by the corresponding pieces of luminance information IR, IG, and IB is closer to white. In the case where the average luminance level APL is smaller, the parameter Gbase is larger, and the gain Gup therefore increases. Conversely, in the case where the average luminance level APL is larger, the parameter Gbase is smaller, and the gain Gup therefore decreases.

Figure 14A:
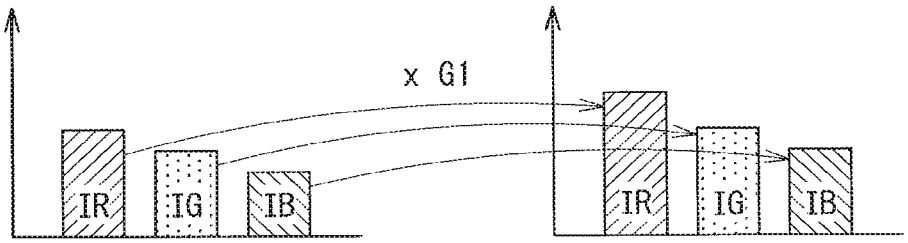
FIGS. 14A to 14C are explanatory diagrams illustrating an exemplary operation of the peak luminance extending section illustrated in FIG. 1.
Figure 14B:
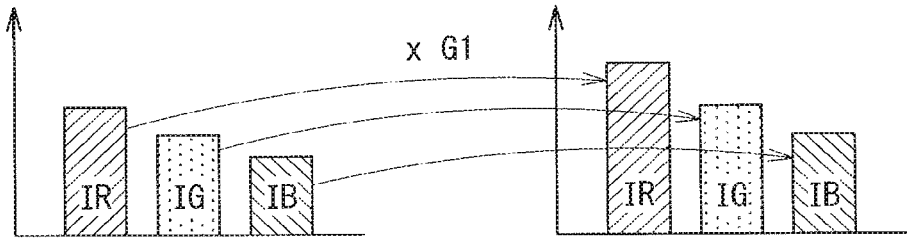
Figure 14C:
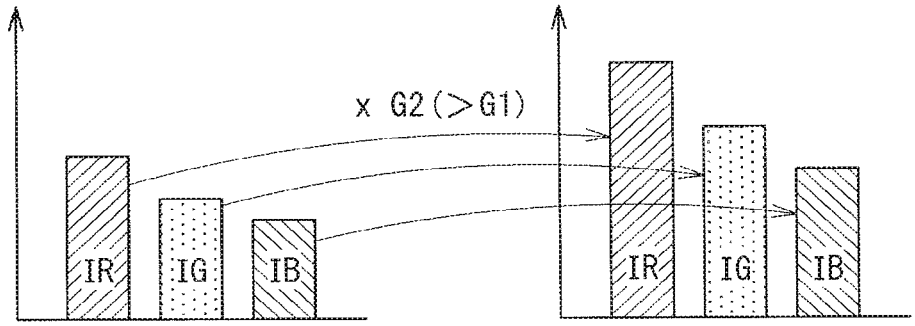

FIGS. 14A to 14C illustrate an exemplary operation of the peak luminance extending section 22. FIGS. 14A to 14C illustrate operations at Values V1 to V3 in the case of the small average luminance level APL in FIG. 13, where FIG. 14A illustrates the operation at the Value V1, FIG. 14B illustrates the operation at the Value V2, and FIG. 14C illustrates the operation at the Value V3. As illustrated in FIG. 13, the gain Gup is fixed to a gain G1 for the Value V equal to or lower than the threshold Vth1. Hence, as illustrated in FIGS. 14A and 14B, the peak luminance extending section 22 multiplies the respective pieces of luminance information IR, IG, and IB by the same gain G1. On the other hand, as illustrated in FIG. 13, in the case where the Value V is equal to or higher than the threshold Vth1, the gain Gup increases. Hence, as illustrated in FIG. 14C, the peak luminance extending section 22 multiplies the respective pieces of luminance information IR, IG, and IB by a gain G2 larger than the gain G1.

In this way, the peak luminance extending section 22 increases the gain Gup with an increase in Value V, to thereby extend luminance. As a result, the dynamic range of the image signal is expanded. Consequently, the display unit 1 displays a high contrast image. For example, when an image of stars twinkling in the night sky is displayed, the stars are displayed more brightly, and when metal such as a coin is displayed, a high contrast image, including representation of luster of the metal, is displayed.

Moreover, as illustrated in FIG. 13, in the display unit 1, the gain Gup has a fixed value for the Value V equal to or lower than the threshold Vth1, and increases with an increase in Value V for the Value V equal to or higher than the threshold Vth1, thereby making it possible to reduce a possibility of darkening of a display image. Specifically, for example, in a display unit disclosed in JP-A-2008-158401, gamma characteristics vary such that peak luminance is extended while luminance in low grayscale tones decreases. This results in darkening of a portion of a display image, the portion being not relevant to extension of peak luminance, leading to a possibility of a reduction in image quality. In contrast, in the display unit 1, the gain Gup has a fixed value for the Value V equal to or lower than the threshold Vth1, which prevents darkening of the portion being not relevant to extension of peak luminance, thereby making it possible to suppress a reduction in image quality.

In addition, in the display unit 1, the gain Gup is varied based on the average luminance level APL, thereby making it possible to improve image quality. Specifically, for example, in the case where a display screen is dark, adaptation luminance of a viewer's eye is low; hence, the viewer is less likely to perceive a difference in grayscale between luminance levels at a high luminance-level portion in the display screen. On the other hand, in the case where a display screen is bright, adaptation luminance of a viewer's eye is high; hence, the viewer is likely to perceive a difference in grayscale between luminance levels at a high luminance-level portion in the display screen. In the display unit 1, the gain Gup is varied based on the average luminance level APL. Hence, for example, in the case where a display screen is dark (the average luminance level APL is low), the gain Gup is increased to facilitate perception of a difference in grayscale between luminance levels. In the ease where a display screen is bright (the average luminance level APL is high), the gain Gup is decreased to prevent excessive perception of a difference in grayscale between luminance levels.

Moreover, in the display unit 1, the gain Gup is varied based on the parameter Garea, thereby making it possible to improve image quality as described below.

FIG. 15 illustrates an exemplary display screen. In this exemplary case, an image of a night sky having a full moon Y1 and a plurality of stars Y2 is displayed. If the gain calculating section 43 calculates the gain Gup without the parameter Garea, the peak luminance extending section 22 in this exemplary case extends peak luminance for respective pieces of luminance information IR, IG, and IB configuring the full moon Y1 and for respective pieces of luminance information IR, IG, and IB configuring the stars Y2. The viewer, however, perceives the full moon Y1 having a large display area to be brighter, but is less likely to perceive such an effect on each of the stars Y2 due to its small area.

Furthermore, for example, in the case where a display unit disclosed in JP-A-2008-158401 displays the image as illustrated in FIG. 15, extension of peak luminance may be suppressed over the entire screen by the full moon Y1 having large area of a bright region.

In contrast, in the display unit 1, the gain Gup is varied based on the parameter Garea. Specifically, as area of a bright region increases in a frame image, the parameter Garea decreases and thus the gain Gup decreases according to Formula (1). Similarly, as area of a bright region decreases, the parameter Garea increases and thus the gain Gup increases according to Formula (1). As a result, in the case of FIG. 15, the parameter Garea decreases in the full moon Y1 due to large area of its bright region, thereby extension of the peak luminance is suppressed. On the other hand, the peak luminance is extended in each star Y2 due to its small area of the bright region. Consequently, luminance relatively increases in the respective portions of the stars Y2, thereby making it possible to improve image quality.

The processing order of the image processing section 20 is now described.

In the display unit 1, the color gamut conversion section 23 is provided at a downstream of the peak luminance extending section 22, so that the color gamut and color temperature of the image signal Sp22 extended in peak luminance are converted to the color gamut and color temperature of the EL display section 13, thereby making it possible to improve image quality. Specifically, if the peak luminance extending section 22 is provided at a downstream of the color gamut conversion section 23, the peak luminance extending section 22 calculates the gain Gup based on the Value V of the luminance information subjected to the color gamut conversion. This may cause, for example, variation in object to be extended in peak luminance (chromaticity range), leading to a possibility of a reduction in image quality. In contrast, in the display unit 1, since the color gamut conversion section 23 is provided at a downstream of the peak luminance extending section 22, the object to be extended in peak luminance (chromaticity range) does not vary, thereby making it possible to suppress a reduction in image quality.

In addition, in the display unit 1, the RGBW conversion section 24 is provided at a downstream of the peak luminance extending section 22, and the RGB signal containing the pieces of luminance information IR, IG, and IB extended in peak luminance is subjected to RGBW conversion, thereby making it possible to suppress a reduction in image quality. Specifically, in general, each sub-pixel SPix of the EL display section 13 may vary in chromaticity depending on signal levels. Hence, if the peak luminance extending section 22 is provided at a downstream of the RGBW conversion section 24, chromaticity of a display image may be shifted. If image processing is performed to avoid this, complicated processing is necessary in consideration of nonlinearity. In contrast, in the display unit 1, the RGBW conversion section 24 is provided at a downstream of the peak luminance extending section 22, thereby making it possible to reduce a possibility of shift in chromaticity of a display image.

In addition, in the display unit 1, the Garea calculating section 92 (FIG. 7) has the scaling section 94 at a downstream of the filter section 94, and the map MAP4 is generated through enlarging scaling based on the smoothened map MAP2, which results in further smoothening of data of the map MAP4, thereby making it possible to suppress a reduction in image quality.

In addition, in the display unit 1, the computing section 96 is provided at a downstream of the scaling section 95, and the computing section 96 obtains the parameter Garea based on the map MAP3 subjected to the enlarging scaling, thereby making it possible to suppress a reduction in image quality as described below.

FIGS. 16A and 16B illustrate the parameter Garea along a line W1 in FIG. 11C, where FIG. 16A illustrates a case where the computing section 96 is provided at a downstream of the scaling section 95, and FIG. 16B illustrates one example where the computing section 96 is provided at an upstream of the scaling section 95. In the case where the calculation section 96 is provided at a downstream of the scaling section 95 (FIG. 16A), the parameter Garea is more smoothened, for example, at a portion W2 than the case where the computing section 96 is provided at an upstream of the scaling section 95 (FIG. 16B).

One reason for this may be considered as follows. Specifically, when the computing section 96 obtains the parameter Garea based on the Value V as illustrated in FIG. 12, the converted parameter Garea may be coarsened in a portion having a high gradient a characteristic line of FIG. 12. Hence, in the case where the computing section 96 is provided at an upstream of the scaling section 95, enlarging scaling is performed based on such coarsened parameter Garea, leading to propagation of errors. As a result, as illustrated in FIG. 16B, smoothness may be reduced, for example, in a portion W3. In contrast, in the display unit 1, the computing section 96 is provided at a downstream of the scaling section 95, thereby making it possible to reduce a possibility of propagation of errors. As a result, as illustrated in FIG. 16A, the parameter Garea is further smoothened. Consequently, a reduction in image quality is suppressed in the display unit 1.

(Overflow Correction Section 25)

Overflow correction of the overflow correction section 25 is now described in detail. In the overflow correction section 25, the gain calculating sections 51R, 51G, and 51B respectively obtain the gains GRof, GGof, and GBof such that the respective pieces of luminance information IR2, IG2, and IB2 do not exceed the predetermined maximum luminance levels, and the amplifying sections 52R, 52G, and 52B respectively multiply the pieces of luminance information IR2, IG2, and IB2 by the gains GRof, GGof, and GBof.

Figure 17A:
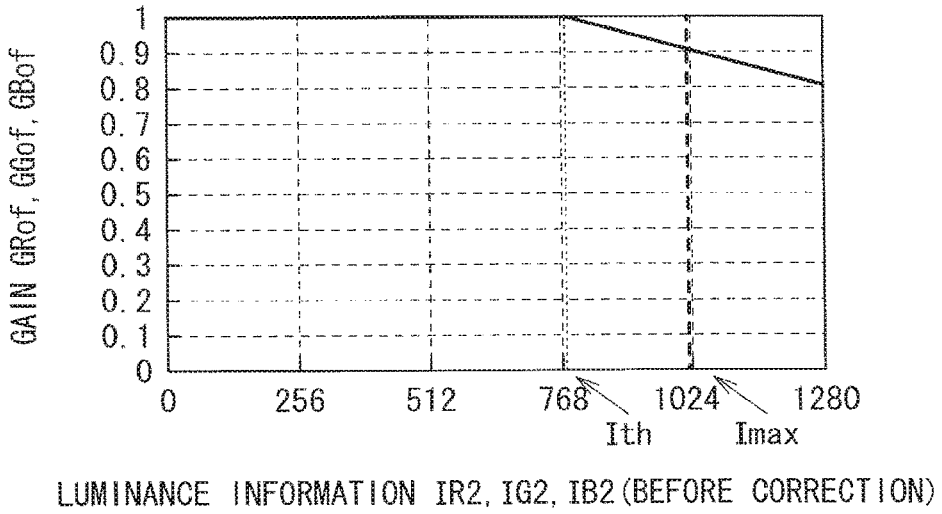
FIGS. 17A and 17B are explanatory diagrams illustrating exemplary characteristics of the overflow correction section illustrated in FIG. 1.
Figure 17B:
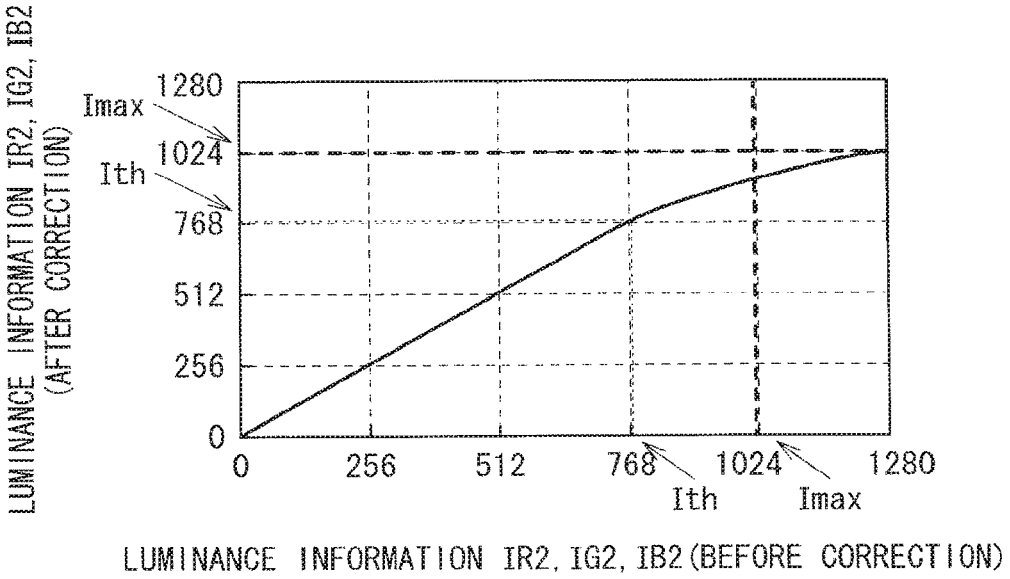

FIGS. 17A and 17B illustrate an exemplary operation of the overflow correction section 25, where FIG. 17A illustrates operations of the gain calculating sections 51R, 51G, and 51B, and FIG. 17B illustrates operations of the amplifying sections 52R, 52G, and 52B. Hereinafter, processing to the luminance information IR2 is described as an example for convenience of description. It is to be noted that the same holds true for processing to the luminance information IG2 and to the luminance information IB2.

As illustrated in FIG. 17A, the gain calculating section 51R calculates the gain GRof based on the luminance information IR2. During this operation, the gain calculating section 51R sets the gain GRof to "1" in the case where the luminance information IR2 is lower than a predetermined luminance value Ith, and sets the gain GRof to be smaller with an increase in luminance information IR2 in the case where the luminance information IR2 is higher than the luminance value Ith.

When the amplifying section 52R multiplies the luminance information IR2 by the gain GRof, as illustrated in FIG. 17B, the luminance information IR2 output from the amplifying section 52R (corrected luminance information IR2) gradually saturates to a predetermined luminance level Imax (in this exemplary case, 1024) after exceeding the luminance value Ith.

In this way, the overflow correction section 25 performs correction to prevent each of the pieces of luminance information IR2, IG2, and IB2 from exceeding the predetermined luminance level Imax. This reduces a possibility of disorder in images. In other words, in the display unit 1, the RGBW conversion section 24 generates the luminance signals IR2, IG2, IB2, and IW2 through the RGBW conversion, and the EL display section 13 performs display based on those luminance signals. During this operation, the RGBW conversion section 24 may generate the luminance signals IR2, IG2, and IB2 each having a level too high for the EL display section 13 to display the signal. If the EL display section 13 performs display based on such pieces of luminance signals IR2, IG2, and IB2 each having an excessively high level, a high-luminance portion is not appropriately displayed, leading to a possibility of disorder in images. In the display unit 1, however, the overflow correction section 25 is provided so that correction is performed to prevent each of the luminance signals IR2, IG2, and IB2 from exceeding the luminance level Imax, thereby making it possible to reduce such disorder in images.

[Effects]

As described above, in this embodiment, the peak luminance extending section is set such that the gain Gup increases with an increase in Value of the luminance information, and thus contrast is improved, thereby making it possible to improve image quality.

Moreover, in this embodiment, since the gain Gup is varied based on the average luminance level, extension of peak luminance is adjustable depending on adaptation luminance of a viewer's eye, thereby making it possible to improve image quality.

Moreover, in this embodiment, since the gain Gup is varied depending on area of a bright region, extension of the peak luminance is suppressed for a portion having large area of the bright region, and luminance is relatively increased for a portion having small area of the bright region, thereby making it possible to improve image quality.

Moreover, in this embodiment, the color gamut conversion section and the RGBW conversion section, etc., are each provided at a downstream the peak luminance extending section, thereby making it possible to suppress a reduction in image quality.

Moreover, in this embodiment, the overflow correction section is provided, and correction is performed such that luminance information does not exceed a predetermined luminance level, thereby making it possible to suppress a reduction in image quality.

Moreover, in this embodiment, the Garea calculating section has the scaling section provided at a downstream of the filter section, and enlarging scaling is performed based on the smoothened map MAP2, thereby making it possible to suppress a reduction in image quality.

Moreover, in this embodiment, the Garea calculating section has the computing section provided at a downstream of the scaling section, and the parameter Garea is obtained based on the map MAP3 subjected to enlarging scaling, thereby making it possible to suppress a reduction in image quality.

[Modification 1-1]

Figure 18:
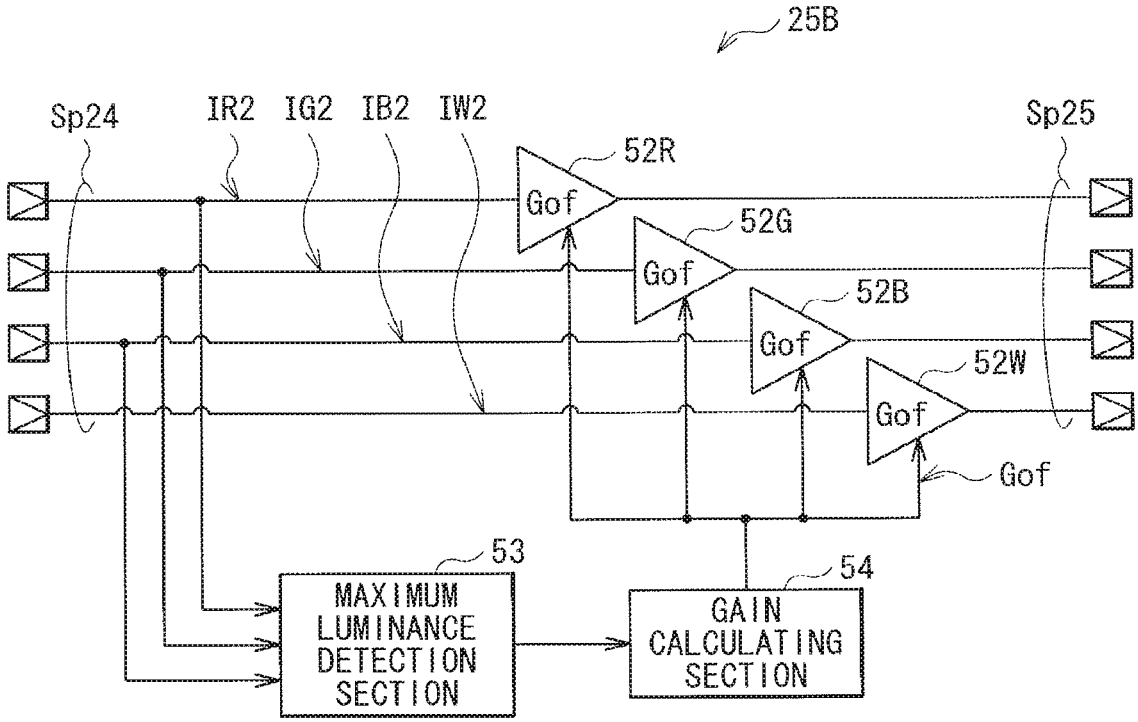
FIG. 18 is a block diagram illustrating an exemplary configuration of an overflow correction section according to a Modification of the first embodiment.

Although the overflow correction section 25 calculates the gains GRof, GGof, and GBof for the respective pieces of luminance information IR2, IG2, and IB2 in the above-described embodiment, the overflow correction section is not limited thereto. Alternatively, for example, as illustrated in FIG. 18, the overflow correction section may calculate a common gain Gof based on the respective pieces of luminance information IR2, IG2, and IB2. An overflow correction section 25B according to Modification 1-1 is now described in detail.

As illustrated in FIG. 18, the overflow correction section 25B includes a maximum luminance detection section 53, a gain calculating section 54, and amplifying sections 52R, 52G, 52B, and 52W. The maximum luminance detection section 53 detects the largest one among the pieces of luminance information IR2, IG2, and IB2. The gain calculating section 54 calculates the gain Gof as in the overflow correction section 25 (FIGS. 17A and 17B) based on the largest luminance information detected by the maximum luminance detection section 53. The amplifying section 52R, 52G, 52B, and 52W multiplies the respective pieces of luminance information IR2, IG2, IB2, and IW2, by the gain Gof.

The overflow correction section 25B according to this Modification multiplies the respective pieces of luminance information IR2, IG2, IB2, and IW2 by the common gain Gof. This reduces a possibility of occurrence of shift in chromaticity. In contrast, the overflow correction section 25 according to the above-described embodiment calculates the gains GRof, GGof, and GBof individually for the pieces of luminance information IR, IG, and IB, which makes it possible to brighten a display image.

[Modification 1-2]

Figure 19:
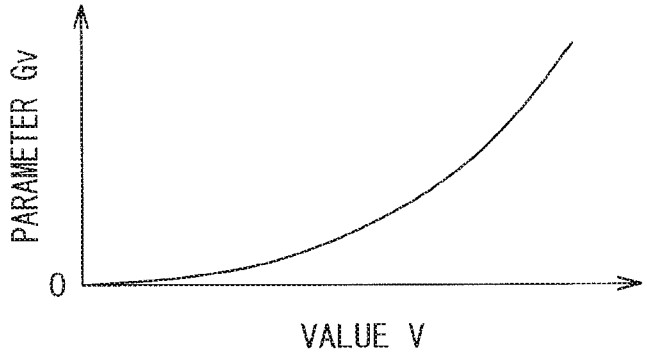
FIG. 19 is an explanatory diagram illustrating a parameter Gv according to another Modification of the first embodiment.

Although the peak luminance extending section 22 obtains the parameter Gv by a function using the Value V in the above-described embodiment, the peak luminance extending section is not limited thereto. Alternatively, for example, the peak luminance extending section may determine the parameter Gv by a lookup table using the Value V. In such a case, a relationship between the parameter Gv and the Value V is more freely set, for example, as illustrated in FIG. 19.

[Modification 1-3]

Figure 20:
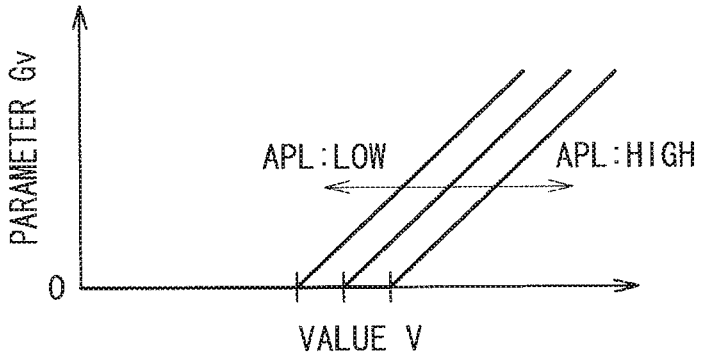
FIG. 20 is an explanatory diagram illustrating a parameter Gv according to another Modification of the first embodiment.
Figure 21:
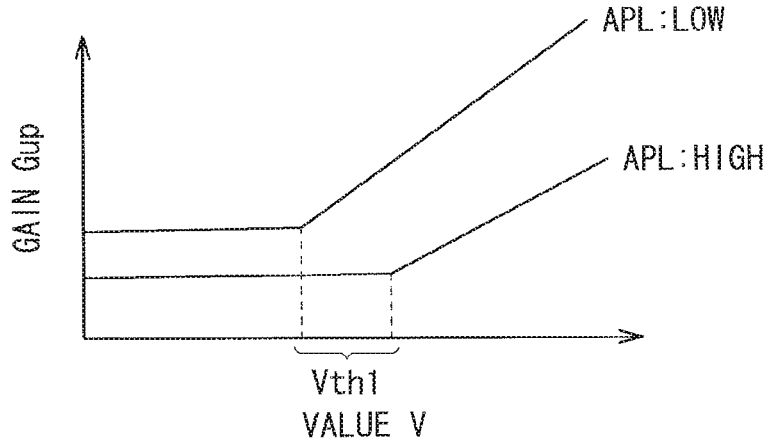
FIG. 21 is an explanatory diagram illustrating exemplary characteristics of a peak luminance extending section according to another Modification of the first embodiment.

Although the peak luminance extending section 22 calculates the parameter Gv based on the Value with the threshold Vth1 as a fixed value in the above-described embodiment, the peak luminance extending section is not limited thereto. Alternatively, for example, as illustrated in FIG. 20, the threshold Vth1 may be decreased in the case of the low average luminance level APL, and the threshold Vth1 may be increased in the case of the high average luminance level APL. As illustrated in FIG. 21, this allows the gain Gup to be increased at and from the low Value V in the case of the low average luminance level APL, and increased at and from the high Value V in the case of the high average luminance level APL, thereby making it possible to compensate a variation in sensitivity due to a variation in adaptation luminance of a viewer's eye.

2. Second Embodiment

A display unit 2 according to a second embodiment is now described. In this embodiment, overflow correction is also performed during extension of the peak luminance. It is to be noted that substantially the same components as those of the display unit 1 according to the first embodiment are designated by the same numerals, and description of them is appropriately omitted.

Figure 22:
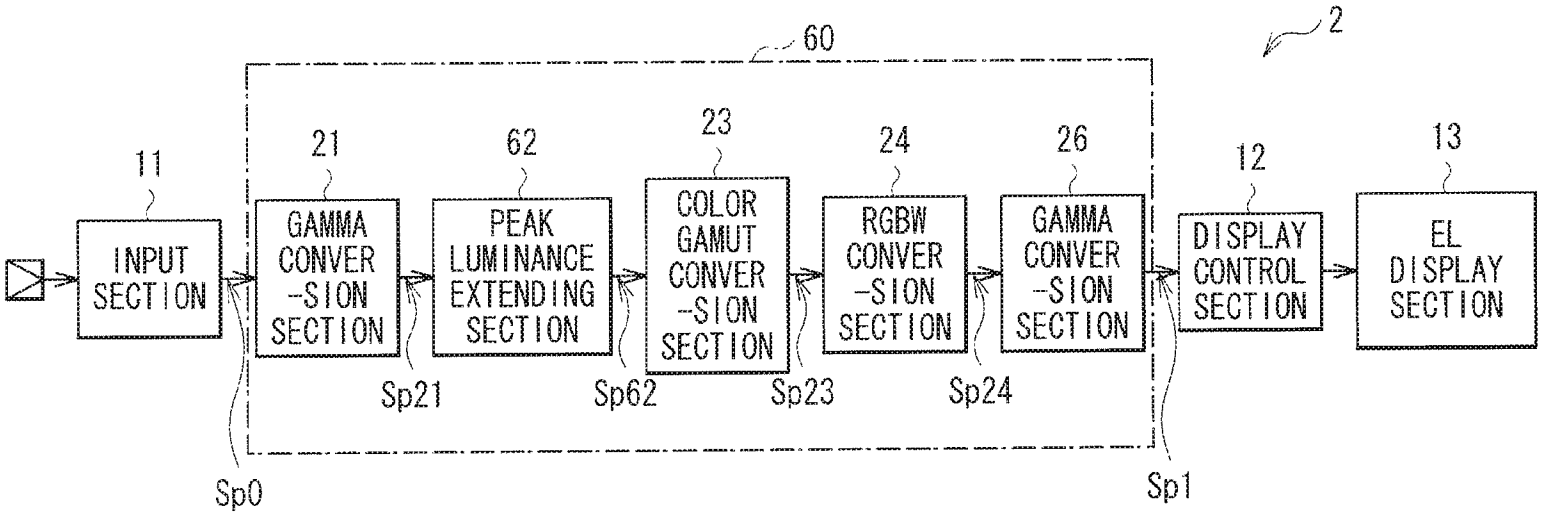
FIG. 22 is a block diagram illustrating an exemplary configuration of a display unit according to a second embodiment.

FIG. 22 illustrates an exemplary configuration of the display unit 2 according to this embodiment. The display unit 2 includes an image processing section 60 having a peak luminance extending section 62. The peak luminance extending section 62 performs overflow correction in addition to extending processing of peak luminance to generate an image signal Sp62. In other words, the peak luminance extending section 62 performs the overflow correction, which has been performed by the overflow correction section 25 in the display unit 1 according to the first embodiment, prior to the RGBW conversion.

Figure 23:
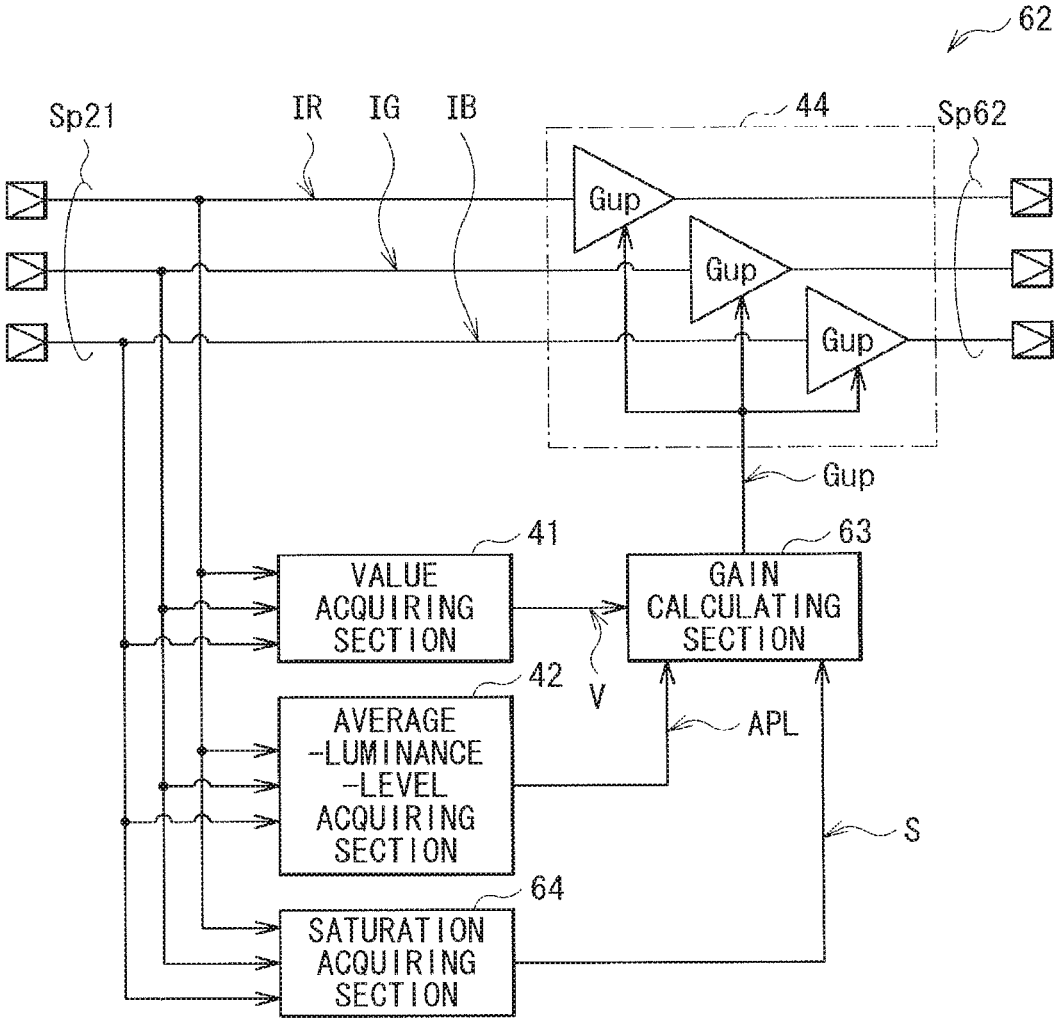
FIG. 23 is an explanatory diagram illustrating an exemplary operation of a peak luminance extending section illustrated in FIG. 22.

FIG. 23 illustrates an exemplary configuration of the peak luminance extending section 62. The peak luminance extending section 62 includes a Saturation acquiring section 64 and a gain calculating section 63. The Saturation acquiring section 64 acquires, for each of pieces of pixel information P, Saturation S in the HSV color space from the pieces of luminance information IR, IG, and IB contained in the image signal Sp21. The gain calculating section 63 calculates the gain Gup based on the Saturation S acquired by the Saturation acquiring section 64, the Value V acquired by the Value acquiring section 41, and the average luminance level APL acquired by the average-luminance-level acquiring section 42.

Figure 24:
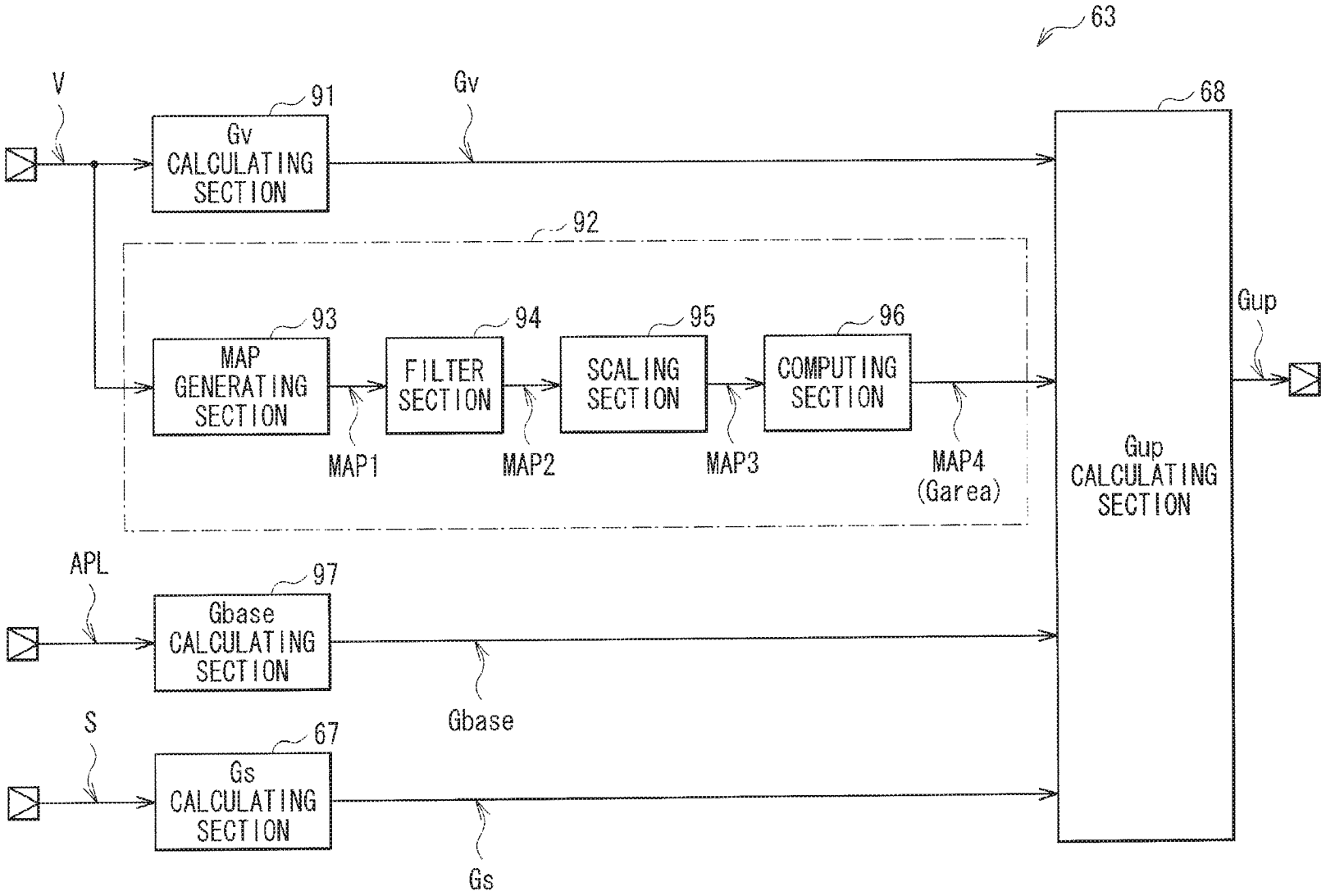
FIG. 24 is a block diagram illustrating an exemplary configuration of a gain calculating section illustrated in FIG. 23.

FIG. 24 illustrates an exemplary configuration of the gain calculating section 63. The gain calculating section 63 includes a Gs calculating section 67 and a Gup calculating section 68.

The Gs calculating section 67 calculates the para Gs based on the Saturation S. The Gs calculating section 67 may include, for example, a lookup table, and uses the lookup table to calculate the parameter Gs based on the Saturation S.

Figure 25:
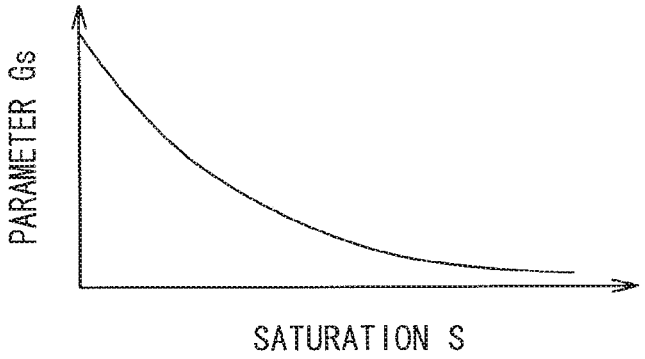
FIG. 25 is an explanatory diagram illustrating a parameter Gs relevant to a Gs calculating section illustrated in FIG. 24.

FIG. 25 illustrates an operation of the Gs calculating section 67. As illustrated in FIG. 25, the Gs calculating section 67 calculates the parameter Cis based on the Saturation S. In this exemplary case, the parameter Gs decreases with an increase in Saturation S.

The Gup calculating section 68 calculates the gain Gup using following Formula (2) based on the parameters Gv, Gbase, Garea, and Gs.

$$Gup=(1+Gv\times Garea\times Gs)\times Gbase \quad (2)$$

In this way, the parameter Gs decreases with an increase in Saturation S in the display unit 2. As a result, the gain Gup decreases, thereby achieving an effect equivalent to the effect of the above-described overflow correction.

As described above, in this embodiment, the parameter Gs is provided, and the gain Gup is varied depending on the Saturation S, thereby allowing the peak luminance extending section to perform overflow correction in addition to the extending processing of peak luminance. Other effects are similar to those in the first embodiment.

[Modification 2-1]

One or more of the Modifications 1-1 to 1-3 of the first embodiment may be applied to the display unit 2 according to the above-described embodiment.

3. Third Embodiment

A display unit 3 according to a third embodiment is now described. The display unit 3 according to this embodiment is configured as a liquid crystal display unit with a liquid crystal display element as a display element. It is to be noted that substantially the same components as those of the display unit 1 according to the first embodiment are designated by the same numerals, and description of them is appropriately omitted.

Figure 26:
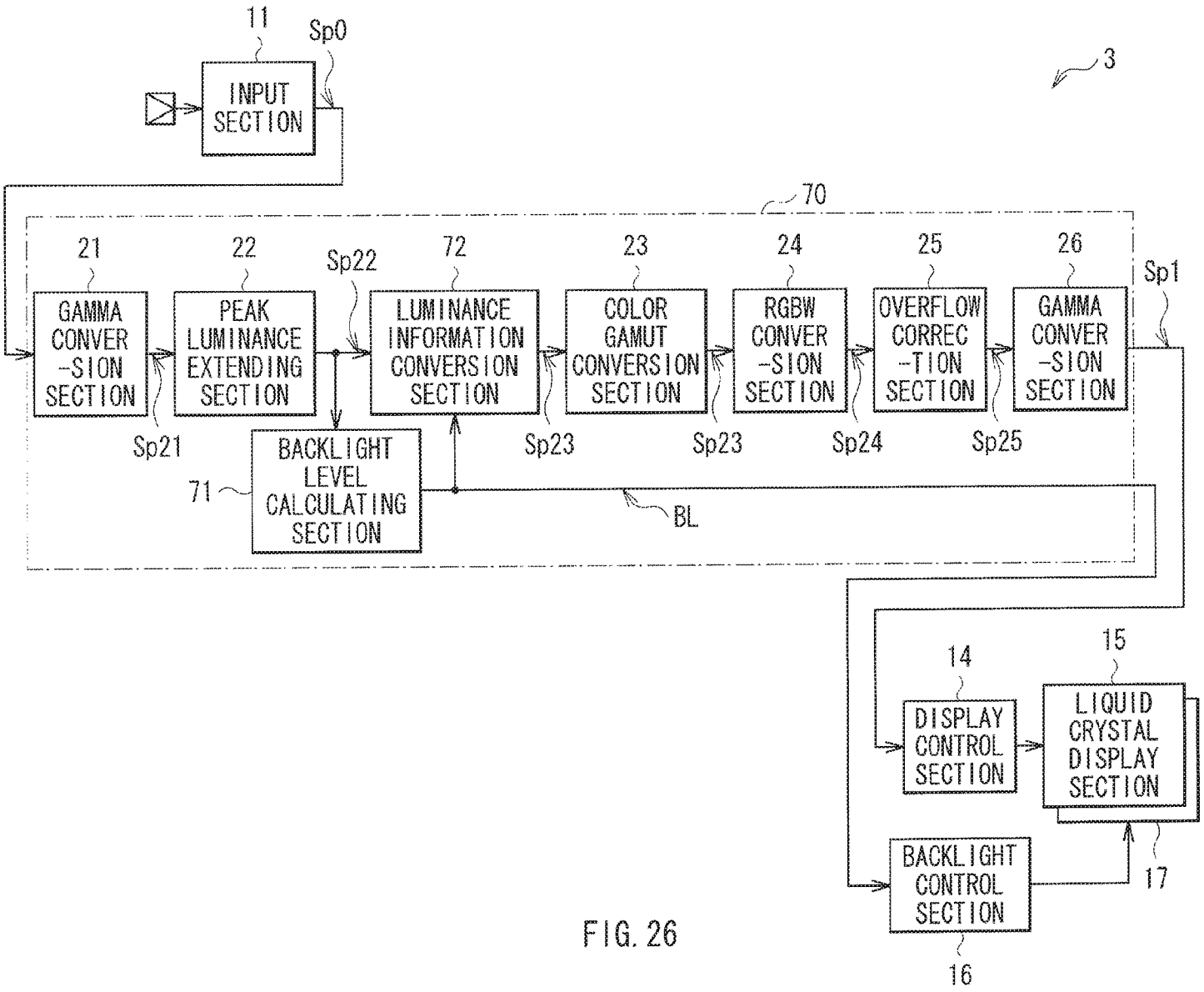
FIG. 26 is a block diagram illustrating an exemplary configuration of a display unit according to a third embodiment.

FIG. 26 illustrates an exemplary configuration of the display unit 3. The display unit 3 includes an image processing section 70, a display control section 14, a liquid crystal display section 15, a backlight control section 16, and a backlight 17.

The image processing section 70 includes a backlight level calculating section 71, and a luminance information conversion section 72. The backlight level calculating section 71 and the luminance information conversion section 72 are provided to achieve a so-called dimming function as described below, which allows for reduction of power consumption of the display unit 3. As for the dimming function, reference is made to, for example, Japanese Unexamined Patent Application Publication No. 2012-27405.

The backlight level calculating section 71 calculates a backlight level BL indicating emission luminance of the backlight 17 based on the image signal Sp22. Specifically, for example, the backlight level calculating section 71 may obtain a peak value of each of pieces of luminance information IR, IG, and IB of each frame image, and calculates the backlight level BL such that emission luminance of the backlight 17 increases with an increase in that peak value.

The luminance information conversion section 72 performs conversion of the pieces of luminance information IR, IG, and IB contained in the image signal Sp22 through dividing the respective pieces of luminance information IR, IG, and IB by the backlight level BL, to thereby generate an image signal Sp72.

The display control section 14 controls a display operation of the liquid crystal display section 15 based on the image signal Sp1. The liquid crystal display section 15 is a display section using a liquid crystal display element as a display element, and performs a display operation based on the control by the display control section 14.

The backlight control section 16 controls light emission of the backlight 17 based on the backlight level BL. The backlight 17 emits light based on the control by the backlight control section 16, and applies the light to the liquid crystal display section 15. The backlight 17 may be configured of, for example, a light emitting diode (LED).

According to such a configuration, in the display unit 3, the backlight level calculating section 71 and the luminance information conversion section 72 adjust the emission luminance of the backlight 17 depending on the respective pieces of luminance information IR, IG, and IB. Thus, the display unit 3 achieves a reduction in power consumption.

Also, in the display unit 3, the backlight level calculating section 71 and the luminance information conversion section 72 are provided at a downstream of the peak luminance extending section 22, and calculation of the backlight level BL and conversion of the respective pieces of luminance information IR, IG, and IB are performed based on the image signal Sp22 extended in peak luminance. Thus, the peak luminance is exclusively extended without darkening the entire screen.

As described above, effects similar to those, in the above-described embodiments and the Modifications are achieved also when embodiments of the present technology are applied to liquid crystal display units.

[Modification 3-1]

One or more of the Modifications 1-1 to 1-3 of the first embodiment, the second embodiment, and the Modification 2-1 of the second embodiment may be applied to the display unit 3 according to the third embodiment.

4. Fourth Embodiment

A display unit 4 according to a fourth embodiment is now described. In this embodiment, an EL display section is configured using a pixel Pix configured of sub-pixels SPix of three colors of red, green, and blue. It is to be noted that substantially the same components as those of the display unit 1 according to the first embodiment, etc., are designated by the same numerals, and description of them is appropriately omitted.

Figure 27:
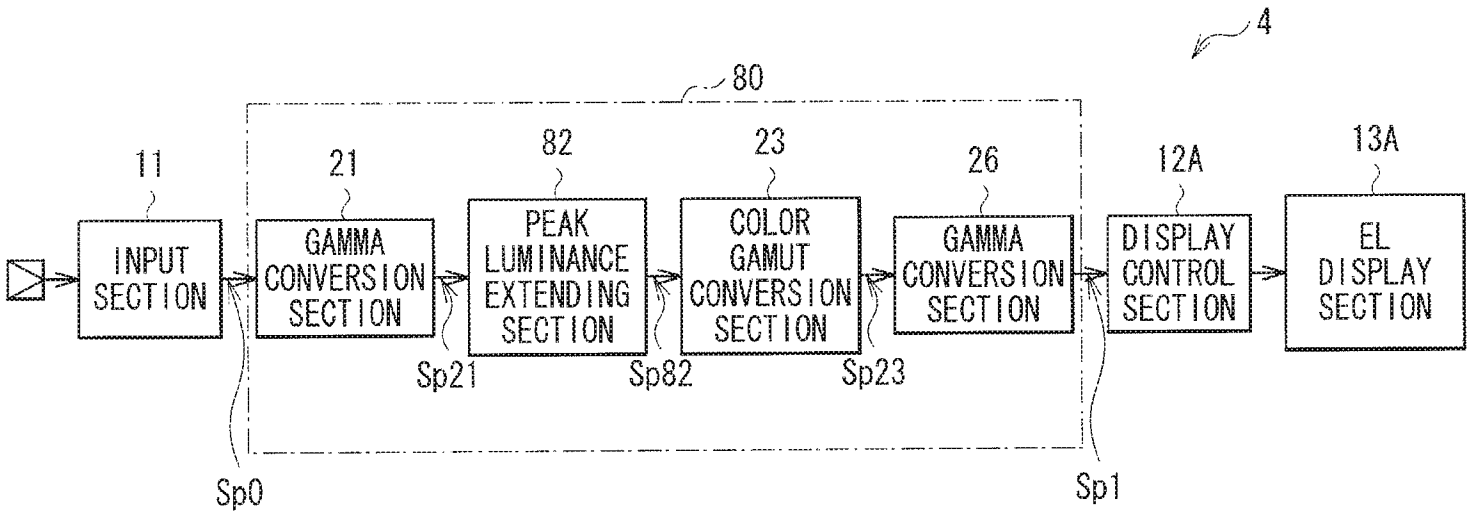
FIG. 27 is a block diagram illustrating an exemplary configuration of a display unit according to a fourth embodiment.

FIG. 27 illustrates an exemplary configuration of the display unit 4. The display unit 4 includes an EL display section 13A, a display control section 12A, and an image processing section 80.

Figure 28:
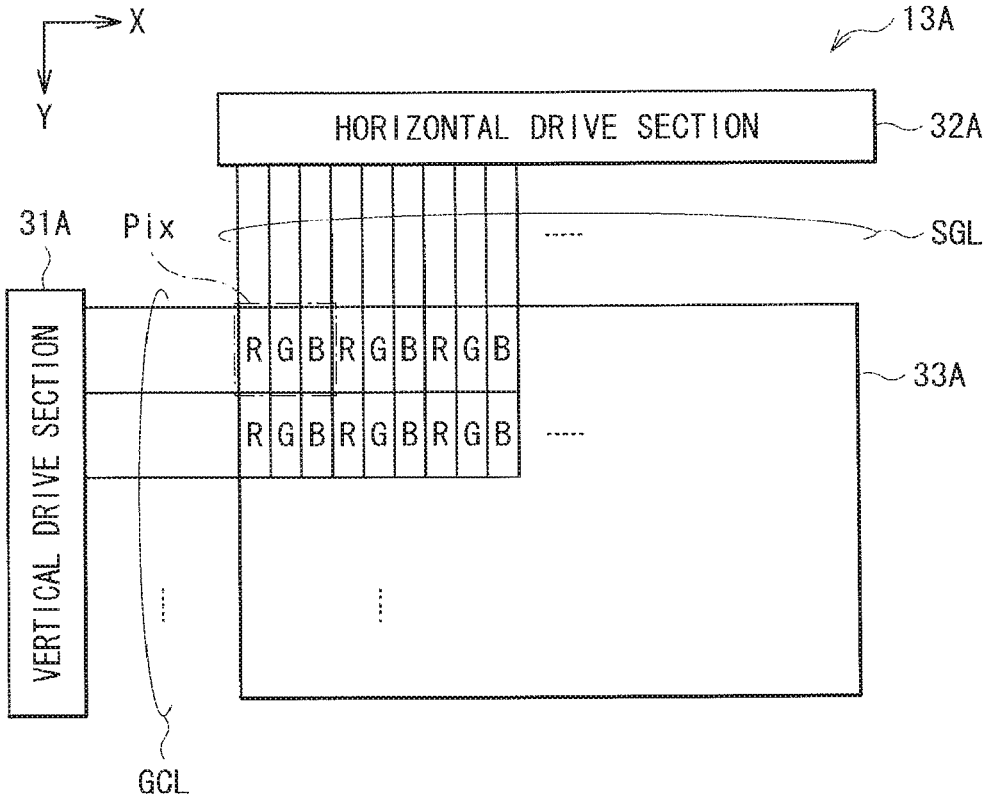
FIG. 28 is a block diagram illustrating an exemplary configuration of an EL display section illustrated in FIG.

FIG. 28 illustrates an exemplary configuration of the EL display section 13A. The EL display section 13A includes a pixel array section 33A, a vertical drive section 31A, and a horizontal drive section 32A. The pixel array section 33A includes the pixels Pix arranged in a matrix. In this exemplary case, each pixel is configured of three sub-pixels SPix of red (R), green (G), and blue (B) extending in a vertical direction Y. In this exemplary case, the pixel includes the sub-pixels SPix of red (R), green (G), and blue (B) arranged in this order from the left. The vertical drive section 31A and the horizontal drive section 32A each drive the pixel array section 33A based on timing control by the display control section 12A.

The display control section 12A controls a display operation of such an EL display section 13A.

As illustrated in FIG. 27, the image processing section 80 includes the gamma conversion section 21, a peak luminance extending section 82, the color gamut conversion section 23, and the gamma conversion section 26. Specifically, the image processing section 80 corresponds to a modification of the image processing section 20 according to the first embodiment (FIG. 1), in which the peak luminance extending section 22 is replaced with the peak luminance extending section 82, and the RGBW conversion section 24 and the overflow correction section 25 are removed.

Figure 29:
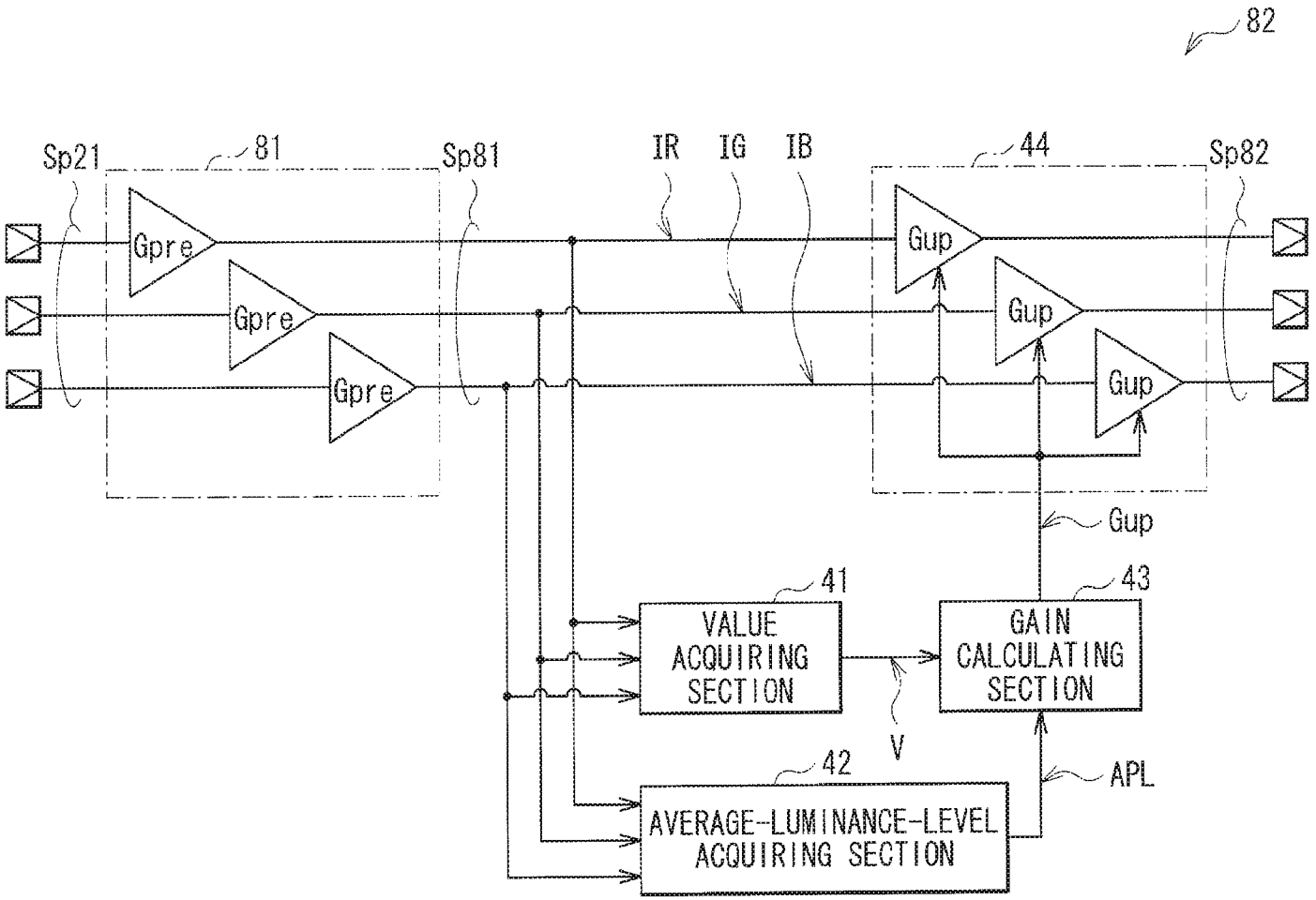
FIG. 29 is a block diagram illustrating an exemplary configuration of a peak luminance extending section illustrated in FIG. 27.

FIG. 29 illustrates an exemplary configuration of the peak luminance extending section 82. The peak luminance extending section 82 includes a multiplication section 81. The multiplication section 81 multiplies the respective pieces of luminance information IR, IG, and IB contained in the image signal Sp21 by a common gain Gpre being 1 or less (for example, 0.8) to generate an image signal Sp81. As in the first embodiment, the Value acquiring section 41, the average-luminance-level acquiring section 42, the gain calculating section 43, and the multiplication section 14 extend peak luminance of each of the pieces of luminance information IR, IG, and IB contained in the image signal Sp81.

In this way, in the display unit 4, first, the respective pieces of luminance information IR, IG, and IB are reduced, and then the corresponding peak luminance is extended as in the first embodiment. During this operation, the peak luminance is extended by the extent corresponding to the reduction in the respective pieces of luminance information IR, IG, and IB, thereby making it possible to extend the peak luminance while a dynamic range is maintained.

In addition, in the display unit 1, as in the first embodiment, since the gain Gup is varied depending on area of a bright region, extension of the peak luminance is suppressed for a portion having large area of the bright region, and luminance is relatively increased for a portion having small area of the bright region, thereby making it possible to improve image quality.

As described above, effects similar to those in the above-described embodiments and the Modifications are achieved also when embodiments of the present technology are applied to EL display units having three colors of sub-pixels.

[Modification 4-1]

One or more of the Modifications 1-1 to 1-3 of the first embodiment, the second embodiment, and the Modification 2-1 of the second embodiment may be applied to the display unit 4 according to the fourth embodiment.

5. Application Examples

Application examples of each of the display units described in the above-described embodiments and the Modifications are now described.

Figure 30:
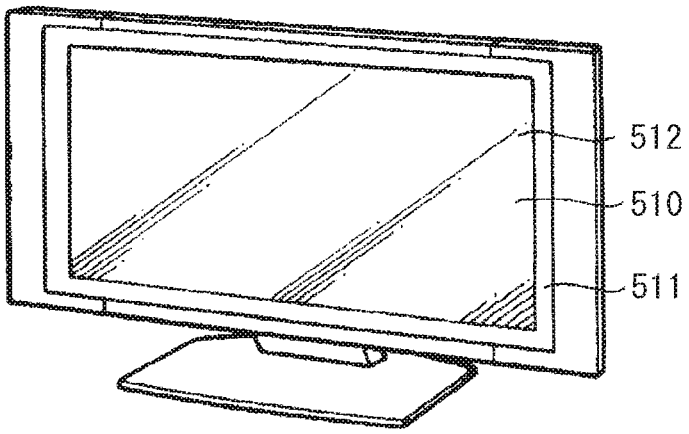
FIG. 30 is a perspective diagram illustrating an appearance configuration of a television unit to which the display unit according to any of the example embodiments and the Modifications is applied.

FIG. 30 illustrates appearance of a television unit to which any of the display units according to the above-described embodiments and the Modifications is applied. The television unit may have, for example, an image display screen section 510 including a front panel 511 and filter glass 512. The television unit is configured of the display unit according to any of the above-described embodiments and the Modifications.

The display unit according to any of the above-described embodiments and the Modifications is applicable to an electronic apparatus in any field. In addition to the television unit, examples of the electronic apparatus may include a digital camera, a notebook personal computer, a mobile terminal unit such as a mobile phone, a portable video game player, and a video camera. In other words, the display unit according to any of the above-described embodiments and the Modifications is applicable to an electronic apparatus that displays images in any field.

Although the present technology has been described with reference to the example embodiments, the Modifications, and the application examples hereinbefore, the technology is not limited thereto, and various modifications or alterations thereof may be made.

Figure 31:
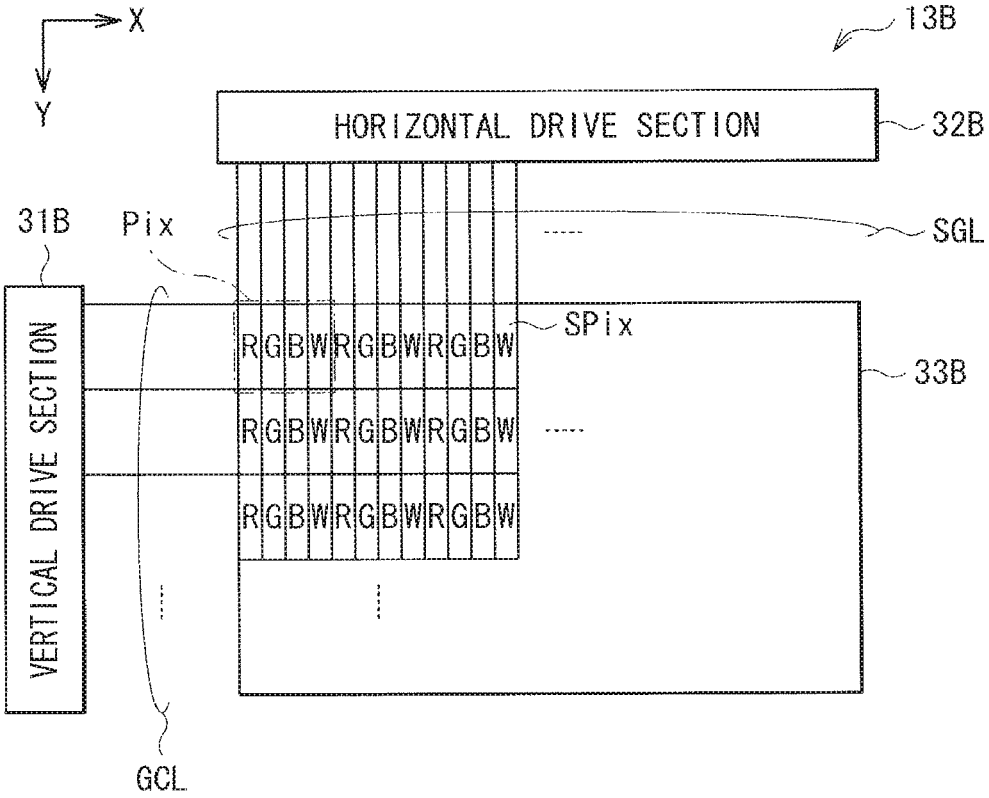
FIG. 31 is a block diagram illustrating an exemplary configuration of an EL display section according to a Modification.

For example, although the four sub-pixels SPix are arranged in a 2×2 matrix to configure the pixel Pix in the pixel array section 33 of the EL display section 13 in any of the above-described first to third embodiments, etc., the pixel configuration is not limited thereto. As illustrated in FIG. 31, four sub-pixels SPix extending in a vertical direction may be arranged side-by-side in a horizontal direction X to configure the pixel Pix. In this exemplary case, the pixel Pix includes the sub-pixels SPix of red (R), green (G), blue (B), and white (W) arranged in this order from the left.

Furthermore, the technology encompasses any possible combination of some or all of the various embodiments described herein and incorporated herein.

It is possible to achieve at least the following configurations from the above-described example embodiments of the disclosure.

(1) A display unit, including:

a gain calculating section obtaining, based on first luminance information for each pixel, a first gain, the first gain being configured to increase with an increase in pixel luminance value in a range where the pixel luminance value is equal to or larger than a predetermined luminance value, and the pixel luminance value being derived from the first luminance information;

a determination section determining, based on the first luminance information and the first gain, second luminance information for each of the pixels; and a display section performing display based on the second luminance information.

(2) The display unit according to (1), wherein the gain calculating section obtains the first gain based on a gain function that represents a relationship between the pixel luminance value and the first gain, and the first gain is configured to increase at a predetermined gradient with the increase in the pixel luminance value that is equal to or larger than the predetermined luminance value, in the gain function.

(3) The display unit according to (1) or (2), wherein the predetermined luminance value is configured to increase with an increase in average of the first luminance information in a frame image.

(4) The display unit according to any one of (1) to (3), wherein the pixel luminance value corresponds to a value of Value information in an HSV color space.

(5) The display unit according to any one of (1) to (4), wherein the display section includes a plurality of display pixels, and each of the display pixels includes a first sub-pixel, a second sub-pixel, a third sub-pixel, and a fourth sub-pixel, the first sub-pixel, the second sub-pixel, and the third sub-pixel being associated with respective wavelengths that are different from one another, and the fourth sub-pixel emitting color light that is different from color light emitted by each of the first sub-pixel, the second sub-pixel, and the third sub-pixel.

(6) The display unit according to (5), wherein the first luminance information contains three pieces of first sub luminance information, the respective three pieces of first sub luminance information corresponding to the first sub-pixel, the second sub-pixel, and the third sub-pixel.

(7) The display unit according to (5), further including a conversion section, wherein the second luminance information contains three pieces of second sub luminance information, the respective three pieces of second sub luminance information corresponding to the first sub-pixel, the second sub-pixel, and the third sub-pixel, wherein the conversion section generates, based on the second luminance information, third luminance information that contains four pieces of third sub luminance information, the respective four pieces of third sub luminance information corresponding to the first sub-pixel, the second sub-pixel, the third sub-pixel, and the fourth sub-pixel, and wherein the display section performs display based on the third luminance information.

(8) The display unit according to (7), wherein the conversion section performs color gamut conversion based on the second luminance information, and generates the third luminance information based on the second luminance information that is subjected to the color gamut conversion.

(9) The display unit according to (7), further including a correction section, wherein the correction section obtains, based on the respective three pieces of third sub luminance information corresponding to the first sub-pixel, the second sub-pixel, and the third sub-pixel among the four pieces of third sub luminance information contained in the third luminance information, second gains for the respective three pieces of third sub luminance information, wherein the correction section generates, based on the three pieces of third sub luminance information and the corresponding second gains, fourth luminance information that contains three pieces of fourth sub luminance information and the third sub luminance information, the respective three pieces of fourth sub luminance information corresponding to the first sub-pixel, the second sub-pixel, and the third sub-pixel, and the third sub luminance information corresponding to the fourth sub pixel, and wherein the display section performs display based on the fourth luminance information.

(10) The display unit according to (9), wherein each of the second gains is configured to decrease with an increase in luminance level in a range where the luminance level is equal to or larger than a predetermined value, the luminance level being represented by the corresponding one of the pieces of third sub luminance information.

(11) The display unit according to (7), further including a correction section, wherein the correction section obtains, based on a largest luminance level among the respective three pieces of third sub luminance information corresponding to the first sub-pixel, the second sub-pixel, and the third sub-pixel among the four pieces of third sub luminance information contained in the third luminance information, a second gain for each pixel, wherein the correction section generates, based on the four pieces of third sub luminance information and the second gain, fourth luminance information that contains four pieces of fourth sub luminance information, the respective four pieces of fourth sub luminance information corresponding to the first sub-pixel, the second sub-pixel, the third sub-pixel, and the fourth sub pixel, and wherein the display section performs display based on the fourth luminance information.

(12) The display unit according to any one of (1) to (8), wherein the gain calculating section acquires Saturation information in an HSV color space from the first luminance information, and corrects the first gain to be reduced with an increase in the Saturation information.

(13) The display unit according to any one of (1) to (12), wherein the gain calculating section corrects the first gain to be reduced with an increase in average of the first luminance information in a frame image.

(14) The display unit according to (5), wherein the first sub-pixel, the second sub-pixel, and the third sub-pixel emit red color light, green color light, and blue color light, respectively, and the color light emitted by the fourth sub-pixel has a luminosity factor that is substantially equal to or higher than a luminosity factor for the green color light emitted by the second sub-pixel.

(15) The display unit according to (14), wherein the fourth sub-pixel emits white color light.

(16) An image processing unit, including:

a gain calculating section obtaining, based on first luminance information for each pixel, a first gain, the first gain being configured to increase with an increase in pixel luminance value in a range where the pixel luminance value is equal to or larger than a predetermined luminance value, and the pixel luminance value being derived from the first luminance information; and a determination section determining, based on the first luminance information and the first gain, second luminance information for each of the pixels.

(17) A display method, including:

obtaining, based on first luminance information for each pixel, a first gain, the first gain increasing with an increase in pixel luminance value in a range where the pixel luminance value is equal to or larger than a predetermined luminance value, and the pixel luminance value being derived from the first luminance information;

determining, based on the first luminance information and the first gain, second luminance information for each of the pixels; and performing display based on the second luminance information.

The present disclosure contains subject matter related to that disclosed in Japanese Priority Patent Application JP 2012-134373 filed in the Japan Patent Office on Jun. 14, 2012, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a display panel including a plurality of self-luminescent pixels respectively configured to display in response to an output image data; and image processing circuitry configured to:

receive an input image data, calculate a gain value for a specific one of the plurality of self-luminescent pixels based on an average luminance level contained in a frame of the input image data and a pixel luminance value acquired from a first luminance information value contained in a part of the frame of the input image data corresponding to the specific one of the plurality of self-luminescent pixels, and generate the output image data based on the gain value and the pixel luminance value acquired from the first luminance information value corresponding to the specific one of the plurality of self-luminescent pixels.

2. The display apparatus according to claim 1, wherein a self-luminescent pixel of the plurality of self-luminescent pixels includes a red sub-pixel, a green sub-pixel, a blue sub-pixel, and a white sub-pixel.

3. The display apparatus according to claim 2, wherein a white light emitted by the white sub-pixel has a luminosity factor that is substantially equal to or higher than a luminosity factor of a color light emitted by the green sub-pixel.

4. The display apparatus according to claim 2, wherein the image processing circuitry is configured to:

compare a red part of the first luminance information value corresponding to the red sub-pixel with a predetermined luminance level, and to correct the red part of the first luminance information based on a comparison result and the gain value, compare a green part of the first luminance information value corresponding to the green sub-pixel with the predetermined luminance level, and to correct the green part of the first luminance information based on a comparison result and the gain value, compare a blue part of the first luminance information value corresponding to the blue sub-pixel with the predetermined luminance level, and to correct the blue part of the first luminance information based on a comparison result and the gain value, and compare a white part of the first luminance information value corresponding to the white sub-pixel with the predetermined luminance level, and to correct the white part of the first luminance information based on a comparison result and the gain value.

5. The display apparatus according to claim 1, wherein the image processing circuitry is configured to set the gain value based on the pixel luminance value acquired from the first luminance information value of the specific one of the plurality of self-luminescent pixels and the average luminance level in a case wherein an area of an image object is smaller than an area of a background image.

6. The display apparatus according to claim 1, wherein the image processing circuitry is configured to set the gain value based on the first luminance information value of the specific one of the plurality of self-luminescent pixels so as to prevent pieces of the luminance information from exceeding a predetermined luminance level.

7. The display apparatus according to claim 1, wherein the image processing circuitry is configured to obtain the gain value, the gain value being configured to increase with an increase in the pixel luminance value in a range within which the pixel luminance value is equal to or larger than a predetermined luminance value, and the pixel luminance value is derived from the first luminance information value.

8. The display apparatus according to claim 7, wherein the image processing circuitry is configured to obtain the gain value based on a gain function that represents a relationship between the pixel luminance value and the gain value, and the gain value is configured to increase at a predetermined gradient with the increase in the pixel luminance value that is equal to or larger than the predetermined luminance value, in the gain function.

9. The display apparatus according to claim 7, wherein the predetermined luminance value is configured to increase with an increase in the average luminance level in a frame image.

10. The display apparatus according to claim 7, wherein the pixel luminance value corresponds to a value of Value information in an HSV color space.

11. The display apparatus according to claim 7, wherein the information processing circuitry is configured to acquire Saturation information in an HSV color space from the first luminance information value, and to modify the gain value so as to be reduced with an increase in the Saturation information.

12. The display apparatus according to claim 7, wherein the information processing circuitry is configured to modify the gain value so as to be reduced with an increase in the average luminance level in a frame image.

13. The display apparatus according to claim 1, wherein the image processing circuitry is configured to determine, based on the first luminance information value and the gain value, a second luminance information value.

14. The display apparatus according to claim 13, wherein the second luminance information value includes a red luminance value corresponding to a red sub-pixel of a pixel among the plurality of self-luminescent pixels, a green luminance value corresponding to a green sub-pixel of the pixel among the plurality of self-luminescent pixels, a blue luminance value corresponding to a blue sub-pixel of the pixel among the plurality of self-luminescent pixels, and a white luminance value corresponding to a white sub-pixel of the pixel among the plurality of self-luminescent pixels.

15. The display apparatus according to claim 14, wherein the image processing circuitry is configured to determine at least one of the red luminance value, the green luminance value, or the blue luminance value, based on the gain value.

16. The display apparatus according to claim 14, wherein the image processing circuitry is configured to determine the white luminance value based on the gain value.

17. The display apparatus according to claim 14, wherein the image processing circuitry is configured to determine each of the red luminance value, the green luminance value, the blue luminance value, and the white luminance value, based on the gain value.

18. The display apparatus according to claim 14, wherein the second luminance information value contains four pieces of sub-luminance information, respective ones of the four pieces of sub-luminance information corresponding to the red sub-pixel, the green sub-pixel, the blue sub-pixel, and the white sub-pixel, and the image processing circuitry is configured to generate an output based on the second luminance information value.

19. The display apparatus according to claim 13, wherein the image processing circuitry is configured to perform a color gamut conversion based on the second luminance information value.

20. The display apparatus according to claim 1, wherein the image processing circuitry is configured to set the gain value based on an area of a first image object and an area of a second image object, in a case where the area of the first image object is larger than the area of the second image object.

* * * * *